US010364639B2

(12) United States Patent
Svartvatn et al.

(10) Patent No.: US 10,364,639 B2
(45) Date of Patent: Jul. 30, 2019

(54) APPARATUS FOR SEALING A BORE, A SYSTEM COMPRISING THE APPARATUS AND A METHOD FOR USING APPARATUS

(71) Applicant: E Holstad Holding AS, Sola (NO)

(72) Inventors: Tommy Svartvatn, Mo i Rana (NO); Tom Henning Bode, Stavanger (NO); Frode Flugheim Heggestad, Sola (NO); Arnulf Bye, Bryne (NO); Thomas Berge, Hafrsfjord (NO); Evald Holstad, Sola (NO); Thomas Bergan Johansen, Stavanger (NO); Oyvind Naess Johannessen, Sandnes (NO)

(73) Assignee: E Holstad Holding AS, Sola (NO)

( * ) Notice: Subject to any disclaimer, the term of this patent is extended or adjusted under 35 U.S.C. 154(b) by 133 days.

(21) Appl. No.: 15/503,461

(22) PCT Filed: Aug. 20, 2015

(86) PCT No.: PCT/NO2015/000019
§ 371 (c)(1),
(2) Date: Feb. 13, 2017

(87) PCT Pub. No.: WO2016/028155
PCT Pub. Date: Feb. 25, 2016

(65) Prior Publication Data

US 2017/0234102 A1 Aug. 17, 2017

(30) Foreign Application Priority Data

Aug. 20, 2014 (NO) ..... 20141002

(51) Int. Cl.
*E21B 33/128* (2006.01)
*E21B 17/10* (2006.01)
(Continued)

(52) U.S. Cl.
CPC ..... *E21B 33/128* (2013.01); *E21B 17/1078* (2013.01); *E21B 23/06* (2013.01);
(Continued)

(58) Field of Classification Search
CPC ..... E21B 23/06; E21B 17/1078; E21B 33/128
See application file for complete search history.

(56) References Cited

U.S. PATENT DOCUMENTS 3,677,341 A * 7/1972 Burns ..... E21B 23/06 166/124
3,891,034 A 6/1975 Owen et al.
(Continued)

FOREIGN PATENT DOCUMENTS

CN 201778799 U 3/2011
GB 2296520 A 3/1996
(Continued)

OTHER PUBLICATIONS

Interwell, Interwell Anchored Production Single Run Straddle—APS, 2013, https://vimeo.com/60990349.
(Continued)

*Primary Examiner* — Kristyn A Hall
(74) *Attorney, Agent, or Firm* — Gable Gotwals

(57) ABSTRACT

This invention relates to a sealing apparatus, system and method for use in a well pipe. The apparatus has a mandrel arranged around a center axis through the apparatus, a radially movable gripping device arranged around the mandrel, a radially movable packer element arranged around the mandrel, and an axially movable activation device designed to set up axial forces for activating the apparatus. The apparatus also includes a radially movable centralizer arranged around the mandrel for centring the apparatus. The activation device being operatively connected to the gripping device, the packer element and the centralizer for the
(Continued)

respective activation and radial movement of each, via power transmission of axial forces, between retracted, passive positions and expanded, active positions relative to the center axis of the apparatus.

12 Claims, 10 Drawing Sheets

(51) Int. Cl.

| | |
|---|---|
| ***E21B 23/06*** | (2006.01) |
| *E21B 33/129* | (2006.01) |
| *E21B 23/01* | (2006.01) |
| *E21B 34/12* | (2006.01) |
| *E21B 34/00* | (2006.01) |

(52) U.S. Cl.
CPC ..... *E21B 23/01* (2013.01); *E21B 33/1292* (2013.01); *E21B 33/1293* (2013.01); *E21B 34/12* (2013.01); *E21B 2034/007* (2013.01)

(56) References Cited

U.S. PATENT DOCUMENTS

| | | | |
|---|---|---|---|
| 3,912,006 | A | 10/1975 | Nutter |
| 4,078,606 | A | 3/1978 | Montgomery |
| 4,671,356 | A | 6/1987 | Barker et al. |
| 4,790,381 | A | 12/1988 | Armell |
| 4,791,988 | A | 12/1988 | Trevillion |
| 5,046,376 | A | 9/1991 | Baker |
| 5,146,993 | A | 9/1992 | Gambertoglio |
| 5,358,040 | A | 10/1994 | Kinley et al. |
| 2002/0170710 | A1 | 11/2002 | Doane et al. |
| 2003/0024710 | A1 | 2/2003 | Post et al. |
| 2003/0132007 | A1 | 7/2003 | Howlett et al. |
| 2004/0194969 | A1 | 10/2004 | Hiorth et al. |
| 2006/0131011 | A1 | 6/2006 | Lynde et al. |
| 2010/0084140 | A1 | 4/2010 | Hern et al. |
| 2010/0175888 | A1* | 7/2010 | Buytaert ..... E21B 17/00 166/373 |
| 2011/0073326 | A1 | 3/2011 | Clemens et al. |
| 2012/0119125 | A1 | 5/2012 | Biester et al. |

FOREIGN PATENT DOCUMENTS

| | | | |
|---|---|---|---|
| WO | 2005045181 | A1 | 5/2005 |
| WO | 2010096861 | A1 | 9/2010 |
| WO | 2012079913 | A2 | 6/2012 |
| WO | 2012082305 | A2 | 6/2012 |
| WO | 2012088008 | A1 | 6/2012 |

OTHER PUBLICATIONS

Interwell, Interwell High Expansion Bridge Plug—HEX, 2012, https://vimeo.com/47654146.
Interwell, Anchored Production Straddle (APS), Serving Every Well, Rev: 3.0-121031.
Interwell, High Expansion Bridge plug (HEX), Serving Every Well, Rev: ME 2011.

* cited by examiner

III-III

XI-XI

XV-XV

APPARATUS FOR SEALING A BORE, A SYSTEM COMPRISING THE APPARATUS AND A METHOD FOR USING APPARATUS

CROSS-REFERENCE TO RELATED APPLICATIONS

This United States application is the National Phase of PCT Application No. PCT/NO2015/000019 filed 20 Aug. 2015, which claims priority to Norwegian Patent Application No. 20141002 filed 20 Aug. 2014, each of which is incorporated herein by reference.

STATEMENT REGARDING FEDERALLY SPONSORED RESEARCH

Not applicable

NAMES OF THE PARTIES TO A JOINT RESEARCH AGREEMENT

Not applicable

REFERENCE TO A SEQUENCE LISTING

Not applicable

BACKGROUND OF THE INVENTION

This invention relates to an apparatus for sealing a bore, a system comprising the apparatus and a method for using the apparatus. It relates, more particularly, to a sealing apparatus for use in a well pipe, the apparatus comprising a mandrel arranged around a centre axis through the apparatus; a radially movable gripping device arranged around the mandrel; a radially movable packer element arranged around the mandrel; and an axially movable activation device designed to set up axial forces for activating the apparatus. The invention also includes a method for using the apparatus in a well pipe.

Plugs may be used in, for example, the petroleum industry in a number of designs to isolate pressure areas and to seal pipes. This may be, for example, during operations in connection with the completion, maintenance and temporary or permanent closing down of a well.

From the publication U.S. Pat. No. 4,671,356 A, a sealing apparatus is known, including a plugging device, an anchoring device, and a centralizer. The plugging device and the centralizer are arranged around a pipe.

From the publication U.S. Pat. No. 3,912,006 A, an assembly of an anchoring device, a centralizer and a packer assembly is known. The anchoring device is configured to prevent axial movement when the packer assembly is being activated.

It can be challenging to ensure that the plug is in the desired position in a well pipe when it is being set in the well pipe; that it maintains its integrity and grip or attachment in the well pipe, that is to say it maintains its position in the well pipe; and possibly that it can easily be removed after use.

Especially in the case of larger pipe dimensions, the position of a plug in the well pipe may be of relatively great importance in how the plug attaches in the well pipe.

Should the plug sit with too large a centre deviation or directional deviation relative to the well pipe, the sealing of the plug may be unreliable. This is particularly relevant if there are large dimensional differences between the outer diameter of the plug and the inner diameter of the pipe, because the dimensional difference may lead to a skew orientation and thereby an unevenly activated packer element. This could also, as will be mentioned later, result in a failure to achieve sufficient anchoring to a pipe wall even though, on the surface, the right indications are received that the activation process which, in its turn, is to set the plug is running as normal.

Some plugs are designed in such a way that the gripping power against the well pipe is reduced if the tensioning of the plug is reduced in consequence of the packer element losing its axial tension. This may happen for example by thermally induced forces in a well and by various types of damage, for example damage from chemicals or mechanical damage.

It is obvious that a plug which has loosened and which is exposed to considerable pressure differences can cause much damage. At worst, the plug can come loose in consequence of high differential pressure from underneath relative to the orientation of the well towards the surface and further behave like a projectile and cause damage to mandatory safety components placed between the setting area of the plug and the access to the well pipe for running well equipment in.

It is also known that plugs may be difficult to remove. Some plugs are not designed to allow easy removal, whereas other plugs may have been exposed to incidents that have damaged setting and/or releasing mechanisms in such plugs. It happens that plugs have to be drilled out to be removable from the well pipe. Plugs that are made mainly from a composite material are known, but then with a limited range of application compared with the present invention.

BRIEF DESCRIPTION OF THE INVENTION

The invention has for its object to remedy or reduce at least one of the drawbacks of the prior art.

The object is achieved according to the invention through the features which are specified in the description below and in the claims that follow.

The invention is defined by the independent claims. The dependent claims define advantageous embodiments of the invention.

According to a first aspect of the invention, a sealing apparatus for use in a well pipe is provided, the apparatus comprising:

- a mandrel arranged around a centre axis through the apparatus;
- a radially movable gripping device arranged around the mandrel;
- a radially movable packer element arranged around the mandrel; and
- an axially movable activation device designed to set up axial forces for activating the apparatus.

The apparatus is characterized by further comprising a radially movable centralizer for centring the apparatus; and

- the activation device being operatively connected to the gripping device, the packer element and the centralizer for the respective activation and radial movement of these, via power transmission of said axial forces, between a retracted, passive position and an expanded, active position relative to the centre axis of the apparatus.

With respect to the movement of the apparatus in the well pipe, the terms radially movable and axially movable refer to movements relative to said centre axis. Axial movements of the apparatus are thus parallel to the centre axis, whereas radial movements are perpendicular to the centre axis. A radial pattern of movement may also include an axial component of movement. Correspondingly, an axial pattern of movement may include a radial component of movement.

According to a second aspect of the invention, there is also provided a system comprising a sealing apparatus and a well pipe, wherein the apparatus is arranged in the well pipe and comprises:

- a mandrel arranged around a centre axis through the apparatus;
- a radially movable gripping device arranged around the mandrel for fixing the apparatus against an inside of the well pipe;
- a radially movable packer element arranged around the mandrel for sealing against the inside of the well pipe and against said mandrel; and
- an axially movable activation device designed to set up axial forces for activating the apparatus in the well pipe. The system is characterized in that the apparatus also comprises a radially movable centralizer arranged around the mandrel for centring the apparatus in the well pipe; and
- the activation device being operatively connected to the gripping device, the packer element and the centralizer for the respective activation and radial movement of these, via power transmission of said axial forces, between a retracted, passive position and an expanded, active position relative to the centre axis of the apparatus.

In this connection, the term "well pipe" covers any type of pipe that is in a well, for example in a petroleum well, and possibly in any phase, in which setting a plug may be appropriate, in the course of development and the lifetime of the well.

The centralizer is arranged to bring at least a portion of the apparatus into an approximately centric position in the well pipe when the centralizer is in its active, expanded position. Together with the other devices of the apparatus, and in particular together with the gripping device, the centralizer may also set the centre axis of the apparatus substantially coaxially with the centre axis of the well pipe during a setting operation.

This relatively accurate setting of the plug in the well pipe is achieved regardless of the angular position of the well pipe in the ground, thereby ensuring that the packer element takes a desired shape and sealing surface against the well pipe as the apparatus is being set against the inside thereof. The centralizer will also make the gripping device have an optimum pipe surface to grip on, so that all the segments will have approximately the same anchoring force.

Further, the packer element may be arranged between the gripping device and the centralizer.

Furthermore, the centralizer may be arranged to be activated before both the gripping device and the packer element are activated.

The latter two features contribute to an improved adjustment of the apparatus in the well pipe before the packer element is activated and set against the inside of the well pipe.

The gripping device and the packer element may also be blocked from being activatable before the centralizer is at least partially activated. Further, such blocking ensures that the apparatus is in a desired position in the well pipe before the apparatus is being activated and set.

The activation device may also include an activator which is rotatable around the centre axis of the apparatus and which is in threaded engagement with a central mandrel through the apparatus. A tensioning of the mandrel relative to the housing of the apparatus has the effect of activating the apparatus. Activation may thereby take place by the activator being rotated around the centre axis of the apparatus. No impacts or pressure need(s) to be applied to the apparatus during a normal setting and pulling operation.

In another embodiment, the activation device may include other technical solutions known per se, to provide a tension in the mandrel.

Further, the apparatus may include a releasing device which is operatively connected to the mandrel, the gripping device, the packer element and the centralizer, the releasing device being arranged for selectively releasing, in a given state, between an inactive retracted position and an active set position, any axial activation forces that might arise between the mandrel on one side and the gripping device, the packer element and the centralizer on the other side. It is normal procedure that a possible differential pressure across the sealing apparatus has been equalized before this work is started, for example by the application of impacts in either an upward or a downward direction before the releasing device is activated.

Such a releasing device may be of great value if the activator should be damaged, or if suitable control equipment is not available. A pulling tool of a kind known per se may be connected to the fishing neck of the apparatus. When, after that, the apparatus is being pulled, it releases from its engagement in the well pipe by the gripping device, the packer element and the centralizer collapsing radially towards the centre axis of the apparatus in consequence of the axial activating forces for these being relieved.

Furthermore, the apparatus may include a valve which is in flow communication with an axial bore extending through the mandrel, the valve being arranged for selective opening and flow of a fluid through the valve, and thereby through the bore of the mandrel.

Such a valve may be used to control flow through the apparatus. The valve may with advantage be adjustable.

Normally, the valve is kept closed while the apparatus is being run in and set. Thereby, the apparatus, on its way down a well pipe, avoids becoming packed with any contaminants present in the pipe. A special feature is the possibility of the valve to be operated from the closed to the open state in areas where there is a risk of crossflows. By such a crossflow it will be advantageous to install the apparatus with an open valve, in order then to shut the valve after the apparatus has been well anchored and set in the well pipe. In this way a substantially equal pressure is maintained around the apparatus until it is completely set in the well pipe. Then the flow through the apparatus may be blocked.

According to a third aspect of the invention, a method for using the apparatus according to the first aspect of the invention in a well pipe is provided, the method comprising the following steps:

- arranging the apparatus with at least the radially movable gripping device and the packer element in a retracted, passive position;
- placing the apparatus in a desired location in the well pipe; and
- activating the apparatus by means of the activation device to bring the apparatus into its active position in which both the centralizer, the gripping device and the packer element are brought into their expanded, active positions, the centralizer in its active position being in contact with the inside of the well pipe, thereby centring the sealing apparatus in the well pipe.

The centralizer may be activated towards its active position before the gripping device and the packer element are activated towards their active positions. The centralizer, the gripping device and the packer element may thus be activated in sequence towards their respective, active positions, wherein the centralizer is activated first.

In one embodiment, the centralizer has already been activated at least partially into its active position before the apparatus is run into the well. Alternatively, the centralizer is activated only after the apparatus has been placed in the desired location in the well pipe.

Before the apparatus is again moved axially in the well pipe, for example in connection with the apparatus being pulled out of the well pipe, the apparatus is brought from its active position into a passive position. In a preferred embodiment, the packer element is brought to its passive position before the gripping device and the centralizer are brought into their passive positions, and preferably, but not necessarily, the gripping device is brought into its passive position before the centralizer is brought into its passive position.

Viewed in the light of the prior art, the inventive features of said gripping device, centralizer, releasing device and valve will be explained in more detail in what follows.

The Gripping Device:

The gripping device includes a number of gripping bodies which are arranged around a centre axis of the gripping device, and which rest against a rest and against a wedge element, the wedge element, by being moved towards the rest, being arranged to bring the gripping body from a passive position to an active position in which the gripping body is arranged to be in engagement with the well pipe.

The abutment surfaces of the gripping body are preferably complementarily adapted to the surfaces of the rest and the wedge element.

In one embodiment, the rest is formed as a wedge element, so that the gripping device includes two wedge elements, referred to as a first wedge element and a second wedge element in what follows.

Gripping devices of this kind are used to be able to fix equipment in a pipe, for example in a well pipe. This may be equipment such as, but not limited to, a well plug, pipe hangers and sensors that are to be hung off. More often than not, it is a question of holding the equipment fixed in an axial position in the well pipe even if the equipment should be subjected to considerable hydraulic or mechanical axial forces from above or below the equipment. The forces may also come from impacts due to falling components or mechanical operations. Such gripping devices may also be used to retrieve tubular bodies by attaching the gripping device and activating gripping devices on the inside of the body. Gripping devices will then be installed on a fishing tool which is run in and out of pipe by means of a wireline, drill pipe or coiled tubing.

Gripping devices are thus used to a considerable extent in well completion and in pressure isolation. In what follows, the operation of the gripping device is explained with reference to a sealing apparatus for pressure isolation, wherein the sealing apparatus includes a sealing body which will also be referred to as a plug in what follows. This does not in any way restrict the scope of the invention to applying only to said sealing apparatus.

It is usual for gripping devices of this kind to be formed with a number of gripping bodies which are arranged around a centre axis of the gripping device and which are arranged to be radially displaceable out towards the well pipe. Often, this displacement is effected by two wedge-shaped elements, against which the gripping bodies rest, the radial displacement of the gripping bodies taking place when the wedge-shaped elements are moved towards and away from each other. The wedge-shaped elements may typically have the shape of a wedge cone.

The gripping device is often engaged together with other components, for example a sealing body in a plug. It is then normal for the axial force that is applied to move the lower wedge cone towards the upper wedge cone, thereby expanding the gripping elements towards the pipe wall, also to be stored in the sealing body which typically consists of an elastomer. If parts of the element should be damaged, or at worst disappear, the tensioning force stored in the packer element will be lost and, next, the tensioning force used to activate the gripping device. The gripping device may then come loose from the well pipe. Damage to the sealing body may occur for example by it being overloaded by thermal structural forces, mechanically damaged or chemically degraded.

From the publication U.S. Pat. No. 4,078,606, a pressure-responsive holding device for maintaining a first cylindrical element fixed against a fluid-pressure-induced longitudinal movement relative to a second element circumscribing the first element is known. The device includes a gripping device which is carried by the first element and which responds to fluid pressure between the two elements by being moved into anchoring engagement with the second element to hold the first element fixed relative to the second element with force which increases as the fluid pressure increases.

From the publication U.S. Pat. No. 5,146,993, a downhole packing mechanism for achieving sealing engagement with a bore in a well is known. The mechanism includes a mandrel positionable within a well. A pipe assembly encircles the mandrel which can be connected, by means of a pawl and an associated guide slot, to the mandrel in connection with running into the well.

From the publication U.S. Pat. No. 4,131,160, a well tool which is provided with gripping bodies that are spring-loaded is known.

Other challenges, not so well known, relating to gripping bodies may be that internal movements occur in the equipment when a pressure from one side of the equipment is removed and applied to the opposite side of the equipment. This is relevant especially for a well plug which is to go through a qualifying course which typically consists in subjecting the plug to pressure from both sides one or more times, and in any order. Pressure from below will typically try to pull the lower wedge cone axially towards the gripping bodies, and the upper wedge cone will tend axially away from the gripping bodies. By pressure from above, the effect will be the opposite; the lower wedge cone will tend axially away from the gripping bodies and the upper wedge cone will tend axially away from the gripping bodies. This may at worst result in a state in which, at a point in time, the equipment is not sufficiently set because of separation between abutment surfaces and thereby a reduction in radial fixing forces out towards the pipe wall, so that the entire equipment may be displaced axially in the well pipe. A displacement of the equipment may result in damage to other equipment placed in the pipe, such as mandatory safety components, and at worst injury to personnel.

Known gripping bodies are usually placed in relatively complicated guides in the wedge-shaped elements to stay in position during setting in the well pipe. This also ensures radial inward displacement of the gripping bodies if the gripping device is to be deactivated. Other known gripping bodies may also be attached with, for example, a leaf spring mounted over the centre of the gripping body or a compression spring working at the centre of the gripping body to prevent the gripping bodies from falling out of the gripping device and to ensure that the gripping body is moved radially inwards when being deactivated.

Guides between the gripping bodies and the wedge-shaped bodies are relatively complicated and thereby costly. Practice has shown that they may also jam, both during setting and during pulling, in consequence of unbalanced loading and thereby self-locking, or by there being particles in the guides, which may lock the movement between the sliding surfaces. Dove-tail grooves or T-grooves are examples of guides which may be prone to jamming.

The gripping device as described in what follows has for its object to remedy or reduce at least one of the drawbacks of the prior art.

According to a first aspect of the gripping device, it includes a number of gripping bodies which are arranged around a centre axis of the gripping device, each of the gripping bodies resting against a rest and against a wedge element, wherein the wedge element, by being moved towards the rest, is arranged to bring the gripping body from a passive position to an active position in which the gripping body is arranged to be in engagement with the well pipe, and the gripping device being characterized by being provided with a releasable grip block.

The function of the grip block is to ensure that the gripping device, after having been set, cannot unintendedly lose its tensioning force, that is to say the force that keeps the gripping bodies of the gripper in radial engagement with the well pipe.

As mentioned, the grip block is releasable. By the grip block being provided with a release mechanism, the grip block can be deactivated, after which the gripping device may be loosened from the well pipe.

The grip block may be spring-loaded into resting against a mandrel which forms part of the activation device of the gripping device. The grip block and the mandrel may both be provided with cooperating locking teeth. The locking teeth may be of a saw-tooth shape. By keeping the mandrel stationary relative to the gripping device after activation of the gripping device, the gripping device thereby stays activated even if unintended events, for example of the kind that is mentioned above, should occur in adjacent equipment.

The grip block may have at least one slanted groove which is in engagement with a correspondingly slanted guide in an intermediate ring, wherein a movement of the intermediate ring in a direction away from the gripping body causes the grip block to be moved radially away from the mandrel and thereby lose its radial grip on the pipe wall. An axial force in the intermediate ring, for example via a housing which is connected to the gripping device, could pull the grip block out of its active position.

A sloping surface on the intermediate ring may rest directly or indirectly against a spring in or at the grip block, the spring-loading of the grip block towards the mandrel being maintained by the intermediate ring being moved in a direction towards the gripping body, thereby releasing the mechanically radially retracted grip block.

To help in the radial inward displacement of the gripping bodies on deactivation, at least one spring may be attached to at least one of the gripping bodies, wherein the spring may be arranged to preload the gripping body in the direction of its passive position. The spring may be attached to all the gripping bodies.

Further, a method for using said gripping device is provided, the method comprising preloading a grip block into engagement with a portion of an activation device arranged to bring gripping bodies into engagement with a well pipe, the engagement of the grip block with the activation device preventing unintentional release of the engagement of the gripping bodies with the well pipe.

The method may further include bringing the gripping bodies from an active position into a passive, retracted position by manipulating the activation device.

The method may further include releasing the gripping bodies by applying an axial force to a housing carrying the gripping device.

The gripping device and the method described above enable improved reliability of the function of the gripping device. It also provides for a simplified construction which contributes to saving space and reducing cost.

The Centralizer:

The centralizer comprises a number of link arms which are mutually spaced around a centre axis of the centralizer and connected to a link-locking sleeve and a sliding sleeve, the link-locking sleeve and the sliding sleeve being arranged, by being moved towards each other by means of an activation device, to bring the link arms from a passive, retracted position into a radially expanded, active position in which they are arranged to be directly or indirectly in engagement with the well pipe, or vice versa, thus from the active position to the passive position.

During work in a well pipe, or any other pipe, it happens relatively often that tools and equipment have to be placed approximately centrically in the well pipe to be able to function satisfactorily. For example, it is conceivable that in connection with a plugging operation, a packer will not seal if the annulus between the tool or equipment and the well pipe is too eccentric, thereby giving too great an expansion in relation to the elasticity range of the packer in the radial direction in which the annulus is largest. Other typical purposes of the centralizer is the ability to centre at least an upper portion of the tool so that the operation of bringing, for example, a pulling and manipulating tool into engagement with the tool is facilitated. In operations in pipes in which experience has shown that accumulations of particles will form above the tool, it will be advantageous to have the connection point centred in the pipe. There will then be a greater chance of the connecting point being free of foreign bodies than if, for example, the connecting point should have an orientation towards the low side of the pipe wall, for example in a horizontal section of a well.

In its simplest form, a centralizer may consist of a number of longitudinal leaf springs which are tensioned outwards and are spaced apart around the tool or equipment, and which push or bend against the well pipe. It turns out that centralizers of this kind often do not give sufficient guarantee of the tool or equipment really taking a centric position in the pipe, or that particles will settle between the leaf springs and the tool, which may lead to the equipment having too large a diameter to be pulled out of a restriction in the pipe. In such an embodiment, the centralizer will scrape against the pipe wall at all times when being run in and out, which leads to unnecessary friction and which may, at worst, result in it sticking in restrictions on the way into or out of the pipe. With a constant contact surface against the wall, the risk of getting stuck in a pipe also increases in that the centralizer leaf springs become worn and jam between equipment and the pipe wall in consequence of the eccentric part breaking off, and having a self-locking effect so that axial movement in the well pipe is prevented.

Activatable centralizers have been developed, in which centring arms, for example, are moved mechanically between a radially retracted, passive position and a radially expanded, active position in which the centring arms are arranged to come into engagement with the well pipe in a radial outward movement relative to the centre axis of the equipment. Preferably, the outer dimension of the centralizer in its collapsed state is the same as the outer dimension of the equipment itself.

From the publication U.S. Pat. No. 5,358,040 A, a centralizer for use in a well pipe is known. The centralizer includes link arms which are connected to an upper sleeve and a lower sleeve. The link arms may be moved axially towards each other by means of an activation device, so that the link arms are brought from a retracted position into an extended position.

From the publication US 2003/0024710 A1, a device for tool transport in a pipe is known, wherein the device may be held fixed to or be released from the inside wall of the pipe. The device includes link arms.

From the publication U.S. Pat. No. 4,790,381 A, a centralizer for use in a well to hold a sensor or some other tool accurately centred in the borehole independently of the angular orientation of the device is known.

From the publication WO 2010/096861 A1, a centralizing tool which includes two centralizers spaced apart axially is known. Each of the centralizers are biased by means of a spring into expanding radially outwards into contact with an inside surface of a pipe. The centralizers are initially locked in a retracted position.

When prior-art centralizers are activated by means of an activation device which also activates other components in the tool or equipment, it may happen that these components and the centralizer are activated in an inappropriate sequence.

There may be unfortunate consequences if the centralizer is deactivated by the activation device unintendedly losing its activating force.

Centralizers consisting of one or more individual components that are attached externally on the equipment are known as well. Centralizers of this kind could also be a centring ring which is pulled over and fixed at a desired point on the equipment which is to be centred. With such a solution, it will not be possible to achieve complete centring because there must be some space between the pipe wall and the centralizer for movement into and out of the pipe to be possible at all. This is particularly challenging when restrictions or narrowings are to be passed in the well. This type of centralizer therefore has a limited range of application and is therefore usually used to reduce friction on equipment which is to be run in and out of a pipe rather than for centring.

The centralizer as described in what follows has for its object to remedy or reduce at least one of the drawbacks of the prior art.

According to a first aspect of the centralizer, it includes a number of link arms which are arranged in a spaced-apart manner around a centre axis, and which are connected to a link-locking sleeve and to a sliding sleeve, the link-locking sleeve and the sliding sleeve being arranged to be moved towards each other by means of an activation device and thereby to bring the link arms from a passive, radially retracted position into a radially expanded, active position in which they are arranged to be, directly or indirectly, in engagement with the well pipe, and the centralizer is characterized by being provided with at least one link-locking body which is directly or indirectly in conditional, blocking engagement with the activation device.

In the preferred embodiment, the link-locking body is in conditional, blocking engagement with the activation device via a mandrel which extends through the centralizer. By arranging the link-locking body in conditional, blocking engagement with the activation device, it is possible to control the order of the activation sequence that controls the centralizer and any other components activated by the same activation device. Such other components may include, for example, but are not limited to, a packer element, a gripping device and/or a valve which could be used in an apparatus which includes the centralizer according to the present invention. For example, other components which are on the opposite side of the centralizer relative to the activation device may not be activated by means of the mandrel and the activating mechanism before the centralizer has been activated, and thereby released from its conditional, blocking engagement with the mandrel.

The link-locking body may be radially displaceable in the link-locking sleeve. In other exemplary embodiments, the link-locking body may be hinged, for example.

The function of the link-locking body is to ensure that, in the axial direction, the link-locking sleeve is connected either to the mandrel or to a housing. A suitable way of achieving this is to give the link-locking body a length in the radial direction which is longer than the radial thickness of the link-locking sleeve. The link-locking body, and thereby the link-locking sleeve, must therefore be in locking engagement with either the mandrel or a portion of a housing which is connected to the centralizer. The sliding sleeve is typically in axial, resilient abutment against the housing. This will in turn result in the centralizer in its entirety being locked against moving axially if the link-locking body is in conditional engagement with the mandrel, whereas if the link-locking body is in conditional locking engagement with the housing, said conditional locking engagement will substantially lock the sliding sleeve and the link-locking sleeve to each other, whereas the centralizer can be moved axially and thereby activate other equipment components.

Thereby it is ensured that only a limited relative movement can take place between the mandrel of the activation device and the link-locking sleeve before the housing has been displaced to a desired position relative to the link-locking sleeve. This relative movement between the link-locking sleeve and the housing has the effect of the link arms being brought into their activated positions by means of the spring-loaded sliding sleeve. After that, the mandrel is free to be moved further relative to the link-locking sleeve and, in its turn, activate any other components that are activated by the same activation device.

The link-locking body may thus be prevented from coming into locking engagement with the housing before the link-locking sleeve and the sliding sleeve are sufficiently close to each other for the link arms to be in their respective activated positions.

The link arms may further be prevented from leaving their active positions before the annular groove of the mandrel is aligned with the link-locking body again.

The link arms may be biased in the direction of their activated positions by means of a biasing means. The biasing means my typically be one or more springs.

Further, a method for a centralizer for use in a well pipe has been provided, the centralizer including a number of link arms distributed around a centre axis and connected to a link-locking sleeve and a sliding sleeve, the link-locking sleeve and the sliding sleeve being arranged, by being moved towards each other by means of an activation device, to bring the link arms from a passive, retracted position into an active position in which they are arranged to be in engagement with the well pipe, and the method is characterized in that it comprises:

providing the centralizer with a link-locking body;

letting the link-locking body directly or indirectly be in conditional engagement with the activation device.

The method may further comprise:

displacing the housing of the centralizer sufficiently relative to the link-locking body until the link-locking body is aligned with a release groove in the housing; and displacing the link-locking body from locking engagement with the activation device.

A centralizer and method described above make it possible for the centralizer, when it cooperates with other components, to be set in a desired sequence. The centralizer is further prevented from releasing unintendedly.

The Releasing Device:

The releasing device is for equipment which is arranged to be used in a well pipe in which an activation device is designed to apply axial forces in different directions to a number of interconnected equipment components. The releasing device includes a suspension part for transmitting the axial forces between the equipment components. By the application of axial forces in different directions to the interconnected equipment components, axial forces will be set up or induced between the equipment components.

When equipment, for example in the form of tools or structures, is to be used in a well pipe, it is often necessary to activate the equipment after it has been placed in the desired position in the well pipe.

Equipment which is to be fixed may be, for example, a well plug, a pipe hanger or other expanding equipment or equipment which has been preinstalled in a pipe, such as a valve. An activation of equipment of such a type will often consist in bringing about radial expansion of fixing and sealing devices by bringing about axial compression between the equipment components. In the activation of a valve, this axial movement will be used to manipulate from open to closed or vice versa.

It is known to activate equipment by means of, for example, tension, pressure, rotation or impact by means of various actuators which may be electrically, hydraulically or mechanically operated. When an activation device is used, it is common to reverse its operation when deactivating the equipment. For example, an electric actuator must be run in the opposite direction of rotation to that used during the activating operation. In many cases, activating mechanisms are irreversible, which presupposes the availability of a separate releasing device in the cases in which it is desirable to loosen or deactivate the equipment. It is common that irreversible activating mechanisms function in such a way that the application of sufficient force to cut an axle with a weakening (typically with a reduced cross-sectional portion) is required, the axle being the point of attachment between a setting tool and the equipment which is to be activated. When this axle is cut, the setting tool is released from the equipment. Further, it is common to provide the equipment with an internal locking mechanism, for example consisting of a ratchet, which has been configured to store the force transmitted from the setting tool to the equipment as the axle is cut. To deactivate the locking mechanism, a separate pulling tool must be used, as will be known to a person skilled in the art.

From the publication US 2002/170710, a release system for a downhole packer is known. The release system comprises a release ring which is activated by a release tool which comprises a collet finger and a conical element which are movable relative to each other. The release ring has alternating cuts and a built-in radially outward bias. The ring is held in a locked position by bands which are broken by the action of the release tool.

From the publication US 2006/131011, a releasing device for a well tool is known. The release mechanism is activated by the radial movement of a locking ring.

It is not unknown that activation devices fail after some time or sustain damage. The causes of failure and damage may be corrosion or general weakening of the physical characteristics of the material because of exposure to chemicals, undesired material attaching to or wedging in the activation device and in extreme cases there may be cold welding of components. The only solution may then be a costly drilling of the equipment or portions of it in order to clean up the well pipe. At worst, the well will have to be abandoned or shut down, which involves large consequences in the form of financial losses.

The releasing device as described in what follows has for its object to remedy or reduce at least one of the drawbacks of the prior art.

According to a first aspect of the releasing device, it includes a suspension part for transmitting the axial forces to the equipment components, the releasing device being characterized in that the suspension part is supported on an activator and configured to work together with the activation device, the suspension part being releasably attached to one of the equipment components.

In one embodiment, the activator is rotatably arranged around a centre axis of the releasing device.

The suspension part forms a holding-up element for the activation device. Thereby the activation device will be relieved when the suspension part is being released.

One equipment component may be constituted by a housing and a second equipment component of a plug activator, and a third one of a corresponding pulling-nut. Said housing includes a third housing portion and a fourth housing portion.

The suspension part may be constituted by a bearing bush.

The bearing bush may be retained axially in the active position by means of a number of release blocks which are arranged mutually spaced apart around the bearing bush. The release blocks may be in radially displaceable engagement with the third housing portion of the housing, and the release blocks may be prevented by means of the fourth housing portion of the housing from being displaceable from their radial engagement with the bearing bush.

The third housing portion and the fourth housing portion may be axially interconnected by means of shear pins, also called release bolts.

The shear pins are configured to break when an axial force above a predetermined magnitude is applied to the third or fourth housing portion, held back by the fourth or third housing portion, respectively. After the release bolts have been broken, an axial displacement between the third housing portion and the fourth housing portion occurs, whereby, at the same time, it is arranged for the release blocks to be allowed a displacement radially outwards from engagement with the bearing bush and into a release groove arranged in the fourth housing portion.

A releasable stop with a shoulder portion may be attached to the fourth housing portion, wherein, on release, the releasable stop is arranged to come into abutment against a corresponding shoulder in the third housing portion. A complete separation of the third housing portion and the fourth housing portion on release is thereby prevented. In one embodiment, the stop is a ring nut.

The bearing flanges of the plug activator may be in engagement with bearing surfaces in the bearing bush. The plug activator is also in engagement with a splined nut in the activation device to absorb rotational forces as will be explained in the special part of the description.

Further, a method for using a releasing device for use in a well pipe is provided, the activation device being designed to apply axial forces in different directions to a number of interconnected equipment components, and the releasing device including a suspension part for transmitting the axial forces between the equipment components, the method comprising:

keeping the suspension part which is supported on an activator, and which cooperates with one of the equipment components, engaged with another one of the equipment components; and releasing the suspension part from this latter equipment component.

The suspension part may be released axially and thereby release axial tensioning forces by displacing a third housing portion axially relative to the fourth housing portion.

When release is to take place, a tool is typically connected to a fishing neck, after which the housing is loaded axially until release bolts that initially connect the third housing portion to the fourth housing portion break.

From the above description it will be understood that the releasing device and the method as described above enable the release of an activation device even if it should be damaged or in some other way not be usable as intended.

The Valve:

The valve which is arranged to be used in a sealing apparatus, comprises a valve housing and a valve slide axially displaceable in the housing and arranged to open for pressure equalization or to be closed, as at least one valve opening in the valve slide is arranged to be brought between a closed position and an open position, wherein, in said open position, it communicates with at least one valve opening of the valve housing.

Valves in equipment that is run into a well pipe are sometimes subjected to unintended strains from adjacent components at times. For example, it happens that valves of this kind are damaged by falling objects in the well pipe. It may also happen that there is no access to the valve mechanism because of particle accumulation. It also happens that the mechanism jams, for example because of corrosion or foreign bodies unintendedly getting into the mechanism. A third case that often occurs in a well pipe in which it is expected that there will be large accumulations of foreign particles, often called debris, is that the foreign particles will pack in the valve mechanism during pressure-testing. This will often cause the valve mechanism to become slower or completely locked. In any case, the valve is then prevented from being operated in the preferred manner.

It is known to activate valves by means of various actuators. When mechanical activation devices are used, it is usual to reverse the operation thereof when valves are being deactivated. For example, during deactivation, an electric actuator must be run with an opposite direction of rotation to that used during the activating operation. For various reasons, it may be impossible to operate the valve in the way intended.

From the publication US 2012/0119125, a valve with a valve housing and a valve slide axially displaceable in the valve housing and arranged to open for pressure equalization or to close is known. In connection with assembling or modifications, the nut-and-screw connection can be released from the valve housing.

From the publication WO 2012/088008, an assembly for operating a valve for controlling flow through a passage is known. The valve includes a closure element which is movable between a closed position, in which the body substantially prevents passage, and an open position. The assembly includes a movable stem having opposing ends, a first end which is connectable to the closure element, so that displacement of the stem moves the closure element between the open and closed positions.

From the publication U.S. Pat. No. 5,046,376, a manual operating device is known, for use together with a valve or other type of device, in order either to provide manual control of the valve in one direction or to form a stop against the movement of the valve away from one of its extreme positions.

As a rule, a valve for use in association with well plugs, the valve being of the kind that is operated by means of a wireline, is closed when being run into the well. The valve remains closed until the well plug is to be pulled, it being important first to equalize the pressure across, for example, the well plug. The normal operation is then to apply a force either downwards or upwards to balance a possible differential pressure across the valve. This is, more often than not, the only way to ensure that the pressure will be equalized before the well plug can be pulled. Problems with such a mechanism may lead to greater challenges and, further, unintended and costly operations.

Valves which cannot be opened in the way intended, for example because of damage, may cause substantial and costly operational disturbances. This relates especially to valves that are mounted in well plugs in which mechanical impacts must be applied upwards to open the valve and pull the plug in the same movement. In wireline operations, especially where mechanical forces are used, it is difficult to say anything about the magnitude of axial forces actually applied to the equipment. This is because stretching of the cable and a combination of weights and a mechanical hammer are used. There will then be a potential risk of opening the valve and pulling the plug in one stroke. If there is then a higher pressure on one of the sides, this may cause operational disturbances as mentioned above.

The valve as described in what follows has for its object to remedy or reduce at least one of the drawbacks of the prior art.

According to a first aspect of the valve which is arranged to be used in a sealing apparatus, it comprises a valve housing and a valve slide axially displaceable in the valve housing and arranged to open for or close against pressure equalization, at least one valve opening in the valve slide is arranged to be brought between a closed position and an open position, wherein, in said open position, it communicates with at least one valve opening in the valve housing, and wherein the valve is characterized in that the valve slide is connected to a nut-and-screw connection which is axially releasably connected to the valve housing.

The nut-and-screw connection may be connected in an axially releasable manner to the valve housing by means of a radially displaceable engagement means placed in an opening in a portion of the nut-and-screw connection and being held, in an active position, in rotatable engagement with a groove in the valve housing by a portion of a valve activator, the engagement means being arranged to be driven, by means of an axial force applied to the valve activator, from the active position, in which the screw-and-nut connection is in engagement with the valve housing, into an inactive position, in which the engagement means is disengaged from the valve housing.

When several valve openings are used, these may be mutually spaced apart in the axial direction and/or in a circumferential direction of the valve.

Said opening for or closing against pressure equalization may be provided by a valve activator, which is in rotary engagement with a blocking nut which forms part of said nut-and-screw connection, being rotated relative to a plug activator, as will be thoroughly explained in the special part of the description. Depending on the direction of rotation of the valve activator, the valve may be opened and closed repeatedly.

If, in a given situation, the opening of the valve by means of the nut-and-screw connection that is normally used for the repeated opening and closing of the valve turns out not to be possible or, for other reasons, is impractical, the valve slide may be displaced axially to open, by the nut-and-screw connection being released axially relative to the valve housing by means of displacement which is brought about by applying an axial force to the valve slide via the rotatable valve activator.

The valve activator has a first end portion which is surrounded by the plug activator, and a second end portion projecting radially from the plug activator.

The first end portion of the valve activator is referred to, in what follows, as the axially inward-projecting portion of the valve activator or just the inward-projecting portion.

The nut of the screw-and-nut connection may be constituted by a blocking nut. The blocking nut may, as mentioned, be held in the axial position relative to the valve housing by means of an engagement means which may comprise at least one valve-stopping block. Said groove may be a block groove. The opening may be arranged in the blocking nut. In its active state, the valve-stopping block may be held in the radial position by an axially inward-projecting portion (see below) of the valve activator.

The valve activator may be supported in a bearing bush and held in the axial position in the valve housing by at least one shear pin via the bearing bush, the bearing bush and thereby the shear pin not being affected by differential pressure that, when the valve is closed, will cause axial forces.

In one embodiment, the blocking nut is externally formed with a number of encircling blocking grooves, a blocking ring, surrounding the blocking nut in such an embodiment, being arranged for one-way displacement along the blocking nut. The blocking ring is axially locked to the valve housing.

The one-way-displaceable blocking ring may be arranged to be non-returnable along the blocking nut, so that the blocking ring prevents the blocking nut and thereby the valve slide from being displaceable towards the closed position while the valve is being shifted towards the open position, even if there should be a differential pressure across the valve that will try to close the valve again during opening.

The axially inward-projecting portion of the valve activator is designed to lose its engagement with the at least one valve-stopping block when the valve activator has been displaced further into the blocking nut.

The blocking nut and thereby the valve slide may be axially displaceable towards the open position in the valve housing when the at least one valve-stopping block is no longer in radial engagement with the block groove.

Further, a method for the opening and closing of a valve according to the above-mentioned first aspect is provided, the method comprising displacing the valve slide from its closed position into its open position by displacing a rotatable valve activator axially in the valve housing by means of an axial force applied.

The method may further comprise:

first displacing the valve activator axially sufficiently for valve-stopping blocks arranged in the valve to lose their radial engagement with a block groove; and then displacing the valve activator axially together with the valve slide further to the open position of the valve slide.

It is thus possible to open the valve by just applying an axial force to the valve activator in the direction of the opening direction of the valve, sufficiently large to break shear pins arranged in the valve, said shear pins holding the valve activator in position axially, and then a force large enough to displace the valve slide in the valve housing against a possible differential pressure across the valve working against the pushing direction.

From the description above, it will be understood that the valve and the method as described above make it possible to release the valve in a simple manner even if the nut-and-screw connection should be damaged or otherwise not be usable as intended.

From the description above, it will be understood that the apparatus, system and method according to the invention enable an improved setting of a packer element or a so-called plug in a well pipe. By means of the invention, a solution which ensures easy release and removal of such plugs after use is provided as well.

BRIEF DESCRIPTION OF SEVERAL VIEW OF THE DRAWING

In what follows, an exemplary embodiment of a sealing apparatus, a system and a method according to the invention is described, which is visualized in the accompanying drawings, in which.

DETAILED DESCRIPTION OF THE INVENTION

Figure 1:
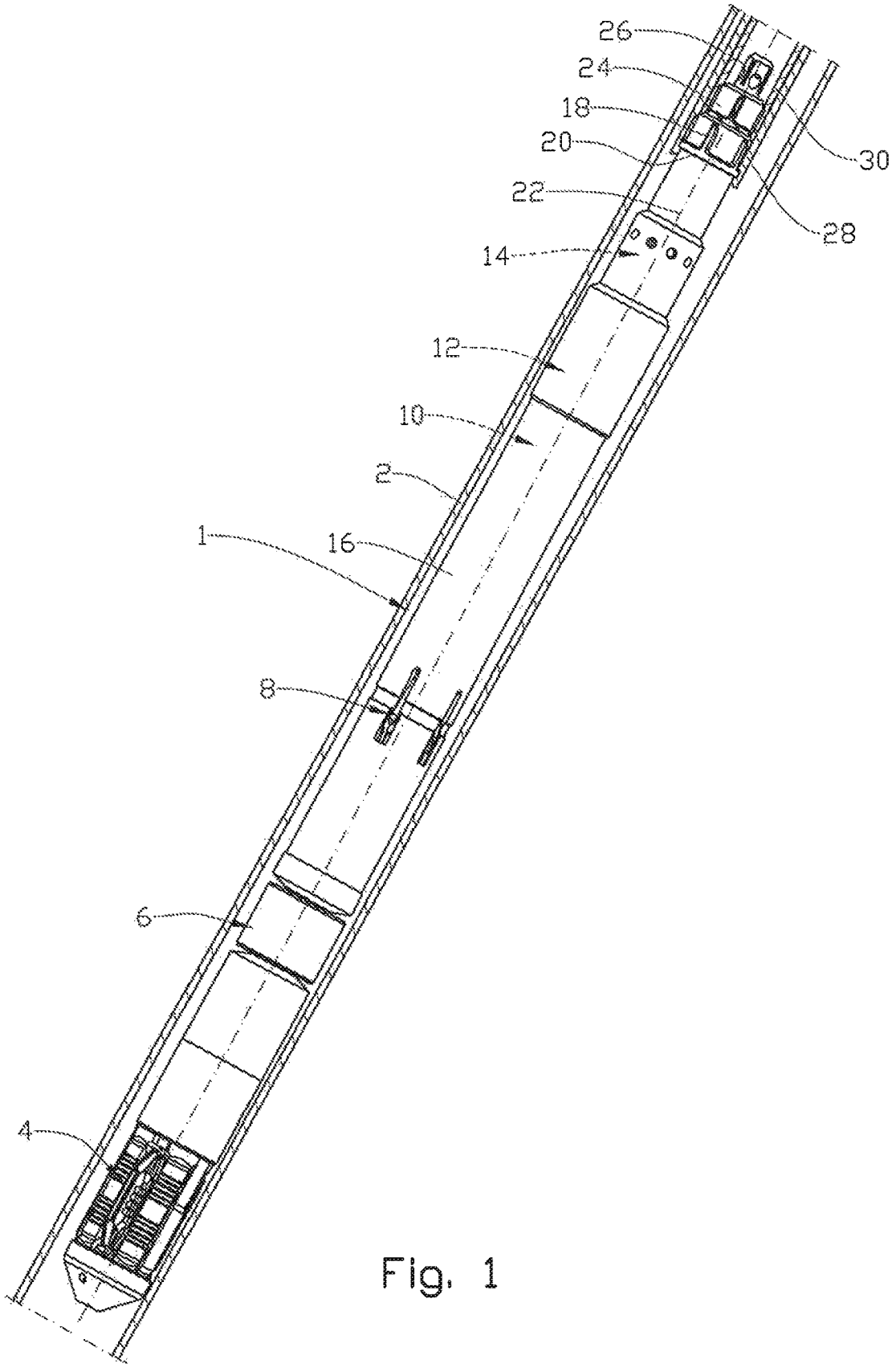
FIG. 1 shows a sealing apparatus according to the invention which is being displaced in a well pipe.

In the drawings, the reference numeral 1 denotes a sealing apparatus according to the invention, positioned in a well pipe 2.

The apparatus 1 according to the invention includes a radially movable gripping device 4, a radially movable packer element 6, a radially movable centralizer 8, an axially movable activation device 10, a releasing device 12 and a valve 14. The activation device 10, releasing device 12 and valve 14 are in the housing 16 of the apparatus 1 and are thereby not shown in FIG. 1 or 2. The designs and operations of these will be explained in what follows. Each of the gripping device 4, packer element 6 and centralizer 8 are radially movable between a passive, retracted position and an active, expanded position relative to a centre axis 22 of the apparatus 1.

The housing 16 is composed of several components which are described in detail in what follows. The housing 16 is provided with a holding-up element 18, that is to say a force-resistant anchoring device, which is arranged to absorb both torsional forces and axial forces. The holding-up element 18 is formed with a fishing neck 20 of a design known per se. An activator 24 which is rotatable around the centre axis 22 of the apparatus 1 projects axially and centrally from the holding-up element 18, whereas a valve activator which is rotatable around the centre axis 22 projects axially and centrically from the activator 24.

Figure 2:
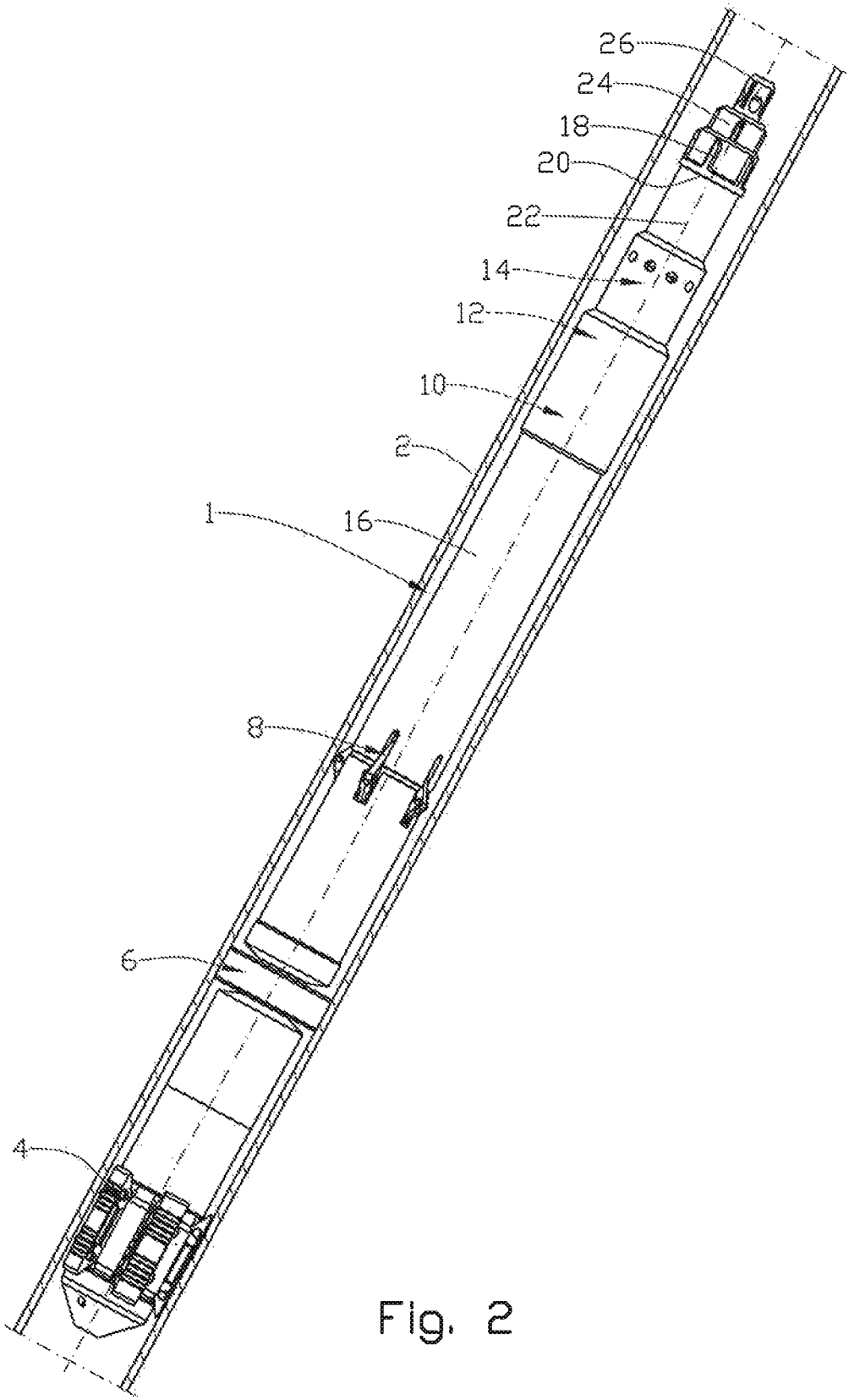
FIG. 2 shows the apparatus after it has been activated and set in the well pipe.
Figure 3:
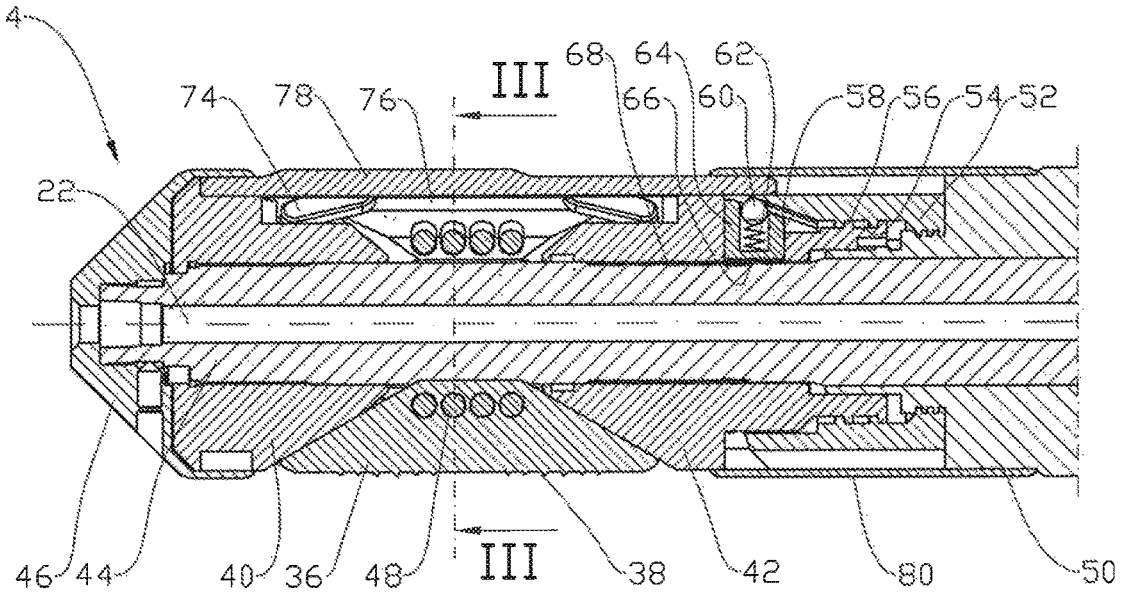
FIG. 3 shows a longitudinal section of the gripping device of the apparatus in a retracted or passive position.
Figure 4:
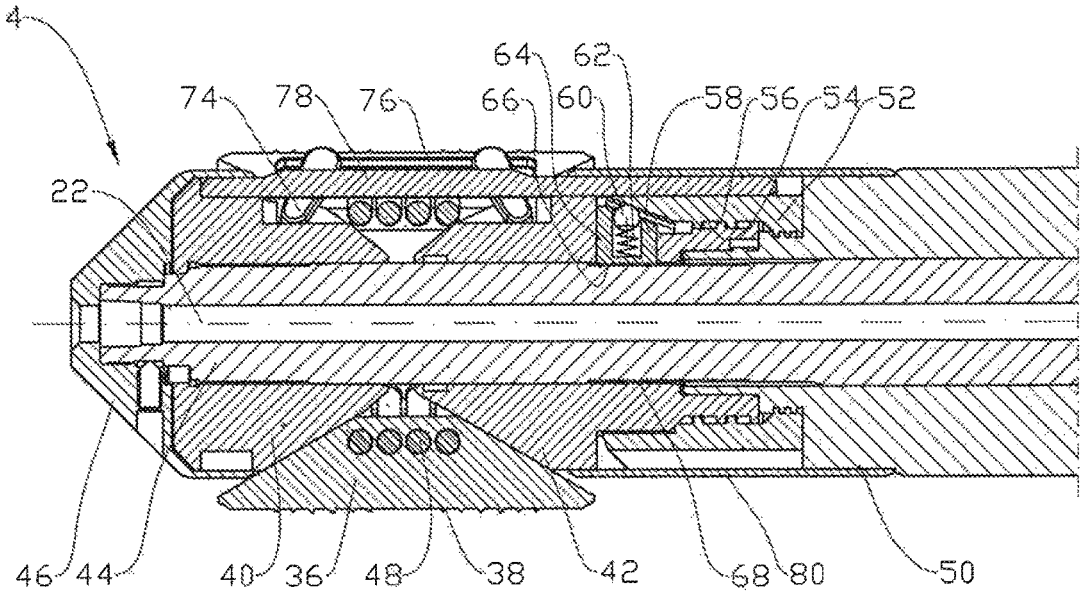
FIG. 4 shows the same as FIG. 3, but the gripping device is in an activated, expanded position.

In FIG. 1, a setting device 28 is connected to the holding-up element 18. The setting device 28 includes an actuator 30 which is arranged to rotate the activator 24 in an optional direction of rotation around the centre axis 22, whereby the activator 24 can be moved in an axial direction along the centre axis 22.

During the axial displacement of the apparatus 1 into the well pipe 2 by means of the setting device 28, the apparatus 1 may be in a non-centred position in the well pipe 2, as indicated in FIG. 1.

When the apparatus 1 is to be set, the gripping device 4 and the centralizer 8 are activated towards their active, expanded positions before the packer element 6 is brought out into its active, expanded position. This is achieved by rotating the activator 24 in a corresponding direction of rotation. In their active, expanded positions, the gripping device 4, packer element 6 and centralizer 8 are in contact with an inside of the well pipe 2. Thereby the apparatus 1 is centred in the well pipe 2, whereby it is ensured that the packer element 6 will come into the correct position in the well pipe 2 when the activator 24 is rotated further in the same plug-setting direction, see FIG. 2.

It is advantageous if the centralizer 8 is activated at least partially before the gripping device 4 is activated. The reason for this is that the gripping device 4, when this has been activated and fixed to the inside of the well pipe 2, could prevent the centralizer 8 from moving the plug 1 into a centred position in the well pipe 2.

In one embodiment (not shown), the centralizer 8 is activated at least partially before or while the apparatus 1 is run into the well pipe 2.

Figure 5:
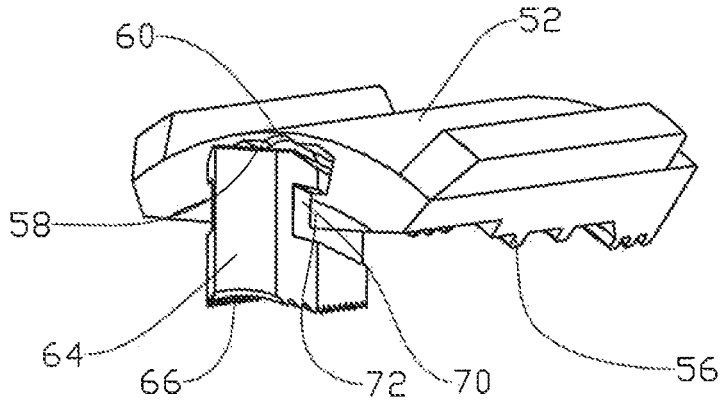
FIG. 5 shows details of the gripping device.
Figure 6:
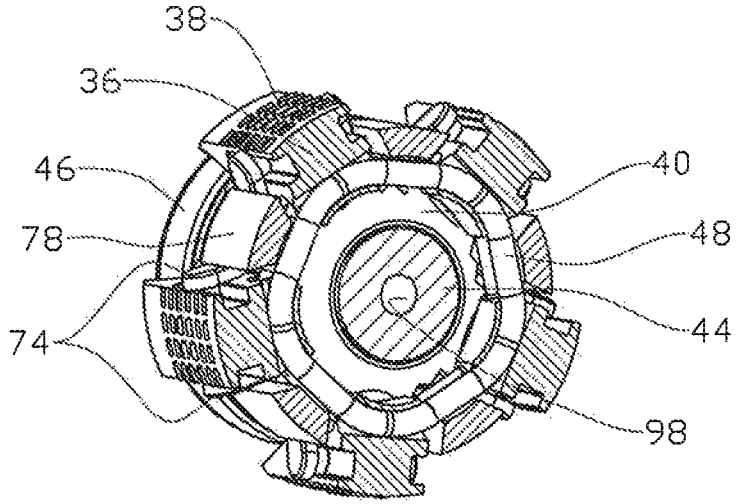
FIG. 6 shows a perspective section viewed along the section line III-III shown in FIG. 3.

The gripping device 4, see FIGS. 3 to 6, includes a number of radially movable and wedge-shaped gripping bodies 36, five gripping bodies 36 shown in FIG. 6, distributed around the centre axis 22. In the embodiment shown, a portion of the external surface of the gripping bodies 36 is formed with teeth 38 which are arranged to engage with the well pipe 2 when the gripping bodies are pressed against the inside of the well pipe 2. The well pipe 2 is shown only in FIGS. 1 and 2. On their radial inside, the gripping bodies 36 rest against a rest 40, 42 shown, here, as wedge cones 40, 42. In what follows, the wedge cone 40 will be referred to as the first wedge cone 40 and the wedge cone 42 as the second wedge cone 42.

By means of a guide nut 46, the first wedge cone 40 is attached to a leading end portion of a centrally placed (in the apparatus 1) mandrel 44. The gripping bodies 36 are biased towards their passive position by means of springs 48, here in the form of helical springs, see FIGS. 3 and 6. The mandrel 44 and the guide nut 46 transmit the axial displacement of the activation device 10 to the gripping device 4, among other things. In this exemplary embodiment, the mandrel 44 and the guide nut 46 may therefore be considered as being part of the activation device 10.

The second wedge cone 42, which is displaceably arranged along the mandrel 44, is restrictedly displaceable axially relative to a first housing portion 50, which forms part of the housing 16. A segmented intermediate ring 52 is attached to the first housing portion 50 and is provided with internal annular grooves 54 in which a flange-shaped ridge 56 of the second wedge cone 42 is displaceably arranged.

The intermediate ring 52 has several sloping faces 58, each resting against a ball 60. Each ball 60 pushes, by means of a spring 62, against a radially displaceable grip block 64 which thereby abuts against the mandrel 44. The grip block 64 is provided with saw-tooth-shaped locking teeth 66 complementarily fitting saw-tooth-shaped locking teeth 68 on the mandrel 44. The grip block 64 engages with the mandrel 44 when the mandrel 44 has been displaced to a position in which the locking teeth 66 of the grip block 64 are aligned with the locking teeth 68 of the mandrel 44.

On two opposite sides, the grip block 64 is proved with slanted grooves 70 fitting with guides 72 on the intermediate ring 52, see FIG. 5.

Each gripping body 36 has been assigned four return arms 74 which are pivotably attached to the first wedge cone 40 and the second wedge cone 42 and which extend in gripping grooves 76 in the gripping body 36. The return arms 74 are arranged to pull the gripping body 36 out of engagement with the well pipe 2.

Between each gripping body 36, there is arranged an elongated segment 78 which is attached to the first wedge cone 40 by means of the guide nut 46 and displaceably arranged relative to the first housing portion 50. The elongated segment 78 may be a leaf spring, for example. At the first housing portion 50, the elongated segment 78 is held in position by means of a segment sleeve 80 which also holds the segmented intermediate ring 52 in position. The segment sleeve 80 is arranged to hold the segmented intermediate ring 52 in position on the first housing portion 50.

When the mandrel 44 is displaced in the direction of the first housing portion 50, the intermediate ring 52 is first moved closer to the second wedge cone 42. The ball 60 is displaced radially inwards by the sloping surface 58, whereby the biasing of the grip block 64 increases.

When the mandrel 44 is displaced further in the direction of the first housing portion 50, the first wedge cone 40 and the second wedge cone 42 are displaced in directions towards each other, whereby the gripping bodies 36 are displaced radially outwards into engagement with the well pipe 2. At the same time, the locking teeth 66 of the grip block 64 engage with the locking teeth 68 of the mandrel 44.

The gripping device 4 is thereby prevented from loosening from the well pipe 2, even if the axial force on the mandrel 44 should be reduced or disappear. The reason is that the saw-tooth-shaped locking teeth 64, 66 will have to be pulled away from each other to release.

It is still possible to release the gripping device 4 from the well pipe 2 by pulling on the housing 16. Typically, a pulling or fishing tool not shown is attached to the fishing neck 20, after which a tensile force is applied to the housing 16 and thereby also to the first housing portion 50.

Thereby there will be a limited displacement of the intermediate ring 52 in the direction away from the second wedge cone 42. The guides 72 of the intermediate ring 52, which are resting against the grooves 70 of the grip block 64, thereby pull the grip block 64 out of its engagement with the mandrel 44. Further displacement of the housing 16 in the direction away from the gripping device 4 has the effect of making the return arms 74 and springs 48 pull the gripping bodies 36 out of their engagements with the well pipe 2 and further in into their passive positions.

Figure 7:
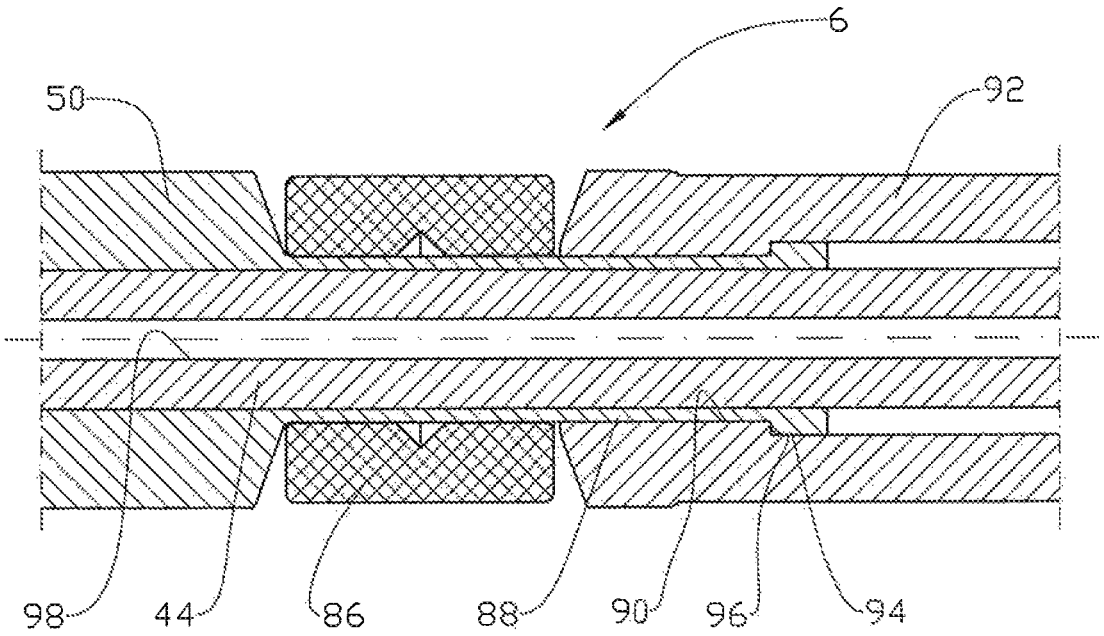
FIG. 7 shows a longitudinal section through the packer element of the apparatus.

In FIG. 7, a longitudinal section of the packer element 6 is shown. An elastic sealing element 86 is arranged on a packer boss 88 appurtenant the first housing portion 50. The packer boss 88 extends in a displaceable manner into a bore 90 of a second housing portion 92 and is prevented from slipping out of the second housing portion 92 by a nut 94 which comes into abutment against a shoulder 96 in the bore 90.

The packer element 86 is activated in a manner known per se by displacing the first housing portion 50 and the second housing portion 92 towards each other, here by means of the mandrel 44 which is provided with an axial bore 98 extending through it.

Figure 8:
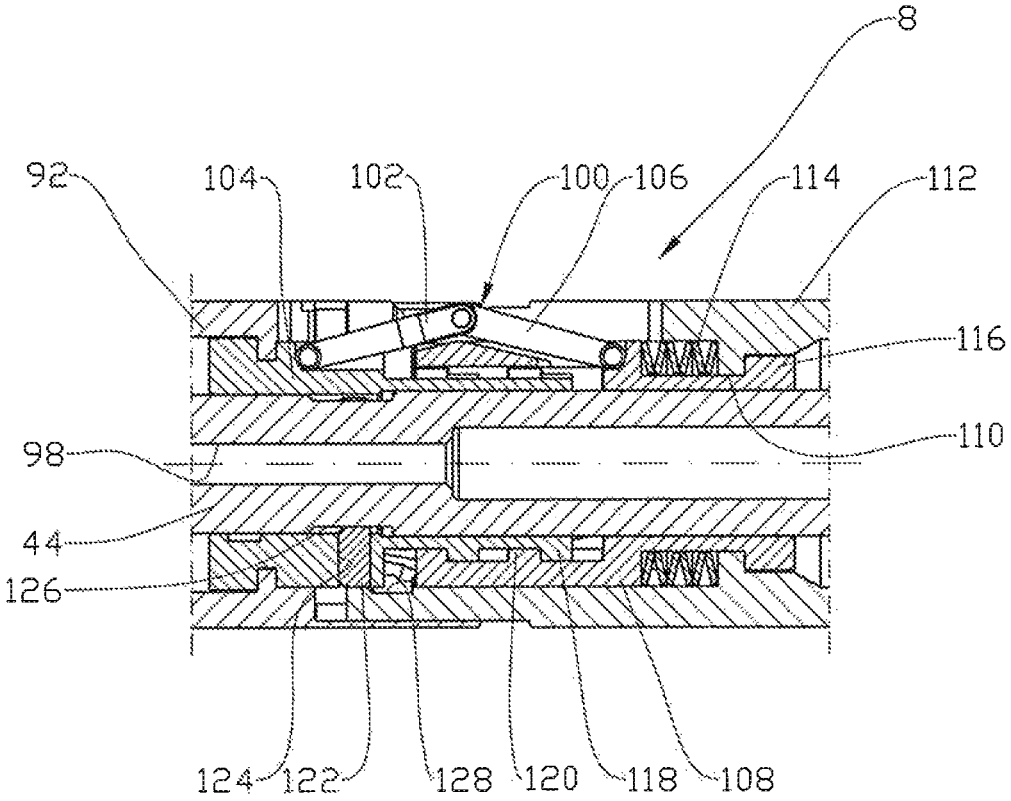
FIG. 8 shows a longitudinal section through the centralizer of the apparatus in a passive position.
Figure 10:
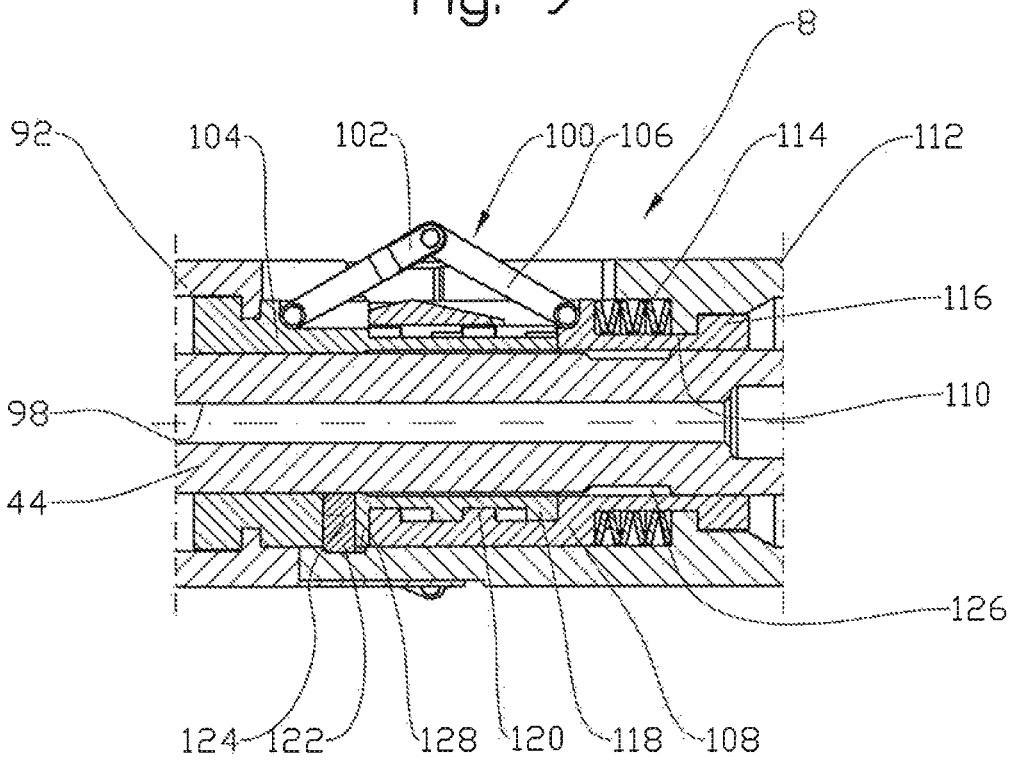
FIG. 10 shows the same as FIG. 8, but the centralizer has been activated and brought into an active position.

The centralizer 8 includes a number of double, hingedly joined link arms 100, here five link arms 100, each of which is arranged to be moved from its passive position, as is shown in FIG. 8, into its active, extended position, as is shown in FIG. 10.

Each of the link arms 100 includes a first link arm 102, which is attached by means of a link joint to a link-locking sleeve 104, and a second link arm 106, which is attached by means of a link joint to a sliding sleeve 108.

The link-locking sleeve 104 is fixedly connected to the second housing portion 92 by means of attachment means not shown, which, in one embodiment, may be screws. The sliding sleeve 108 is restrictedly displaceable in a bore 110 in a third housing portion 112.

Springs 114, here in the form of disc springs, bias the sliding sleeve 108 in the direction of the link-locking sleeve 104, but it is prevented from slipping out of the bore 110 by a nut 116.

The link-locking sleeve 104 is formed with external lugs 118. The sliding sleeve 108, which is restrictedly displaceable relative to the link-locking sleeve 104, is provided with internal lugs 120. The external lugs 118 and the internal lugs 120 are arranged to come into abutment against each other. Both the link-locking sleeve 104 and the sliding sleeve 108 are arranged in a displaceable manner on the mandrel 44.

A link-locking body 122, which is radially displaceable in a guide opening 124 in the link-locking sleeve 104, is in engagement with an annular groove 126 in the mandrel 44 in its initial position, as is shown in FIG. 8. Together with other link-locking bodies, not shown, arranged around a centre axis 22, the link-locking body 122 is prevented from disengaging from the mandrel 44 before the link-locking body 122 is aligned with an annular, internal release groove 128 of the third housing portion 112.

Figure 9:
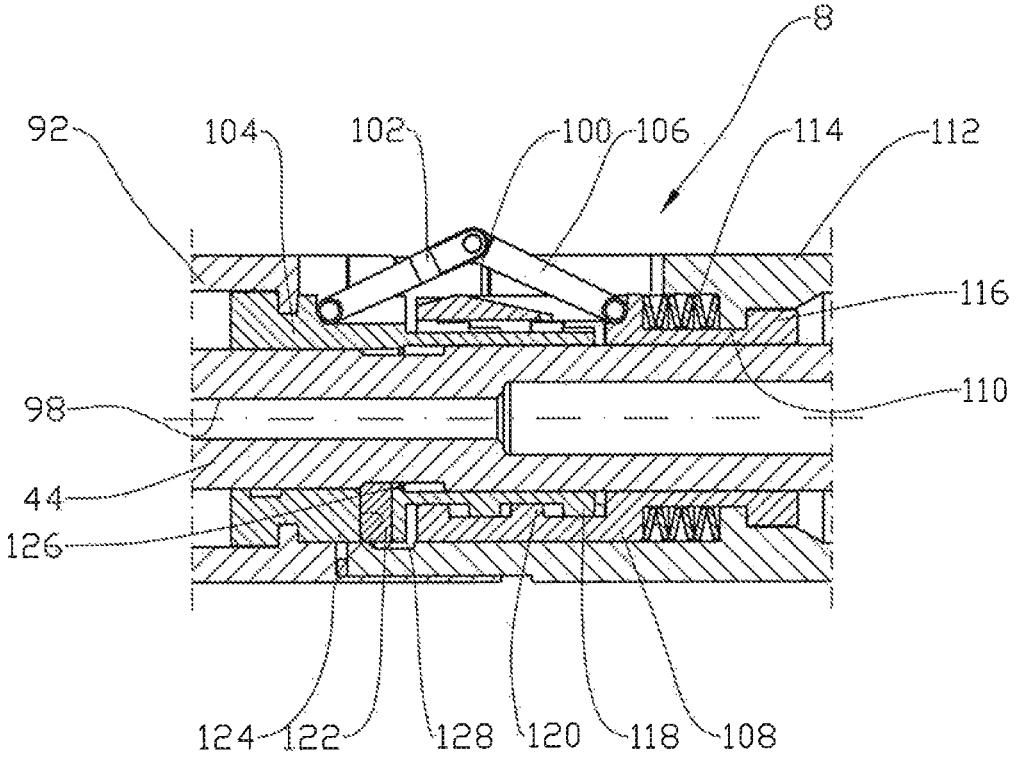
FIG. 9 shows the same as FIG. 8, but the centralizer is being activated.

In FIG. 9, the mandrel 44 has been pulled into axial abutment against the link-locking body 122. The second housing portion 92, and thereby the link-locking sleeve 104, has been displaced somewhat in the direction of the sliding sleeve 108, but not sufficiently for the link-locking body 122 to be displaceable into the release groove 128. This displacement between the second housing portion 92 and the third housing portion 112 has the effect of the link arms 100 having been displaced somewhat towards their active positions.

The mandrel 44 is prevented from getting further displaced relative to the link-locking sleeve 104, and thereby relative to the second housing portion 92. In this exemplary embodiment, the effect of this is that the centralizer 8 must be activated towards its active position before the gripping device 4 (see FIGS. 3 and 4) and the packer element 6 (see FIG. 7) can be activated towards their respective, active positions.

When the mandrel 44 has been moved sufficiently far relative to the third housing portion 112, as is shown in FIG. 10, the link-locking body 122 is displaced radially out into the release groove 128. With this, the mandrel 44 is released from the link-locking body 122 and can thereby be displaced further in the direction of the third housing portion 112.

In this position, the link-locking body 122 is prevented from being displaced out of the release groove 128. The centralizer 8 is thereby held in its active, expanded position. The centralizer 8 cannot be released until the annular groove 125 of the mandrel 44 has been moved back to the link-locking bodies 122, that is to say when the annular groove 126 is axially aligned with the link-locking body 122.

If the link arms 100 are prevented from being fully displaceable into their activated and extended positions, the springs 114 are being tensioned while the sliding sleeve 108 is displaced somewhat in the bore 110.

From the description above, it will therefore be understood that the centralizer 8 is provided with a link-locking body 122 which is directly or indirectly in conditional, blocking engagement with the activation device 10; when the link-locking body 122 is in conditional engagement with the mandrel 44, that is dependent on it not being in engagement with the housing with which it may be engaged in another state.

Figure 11:
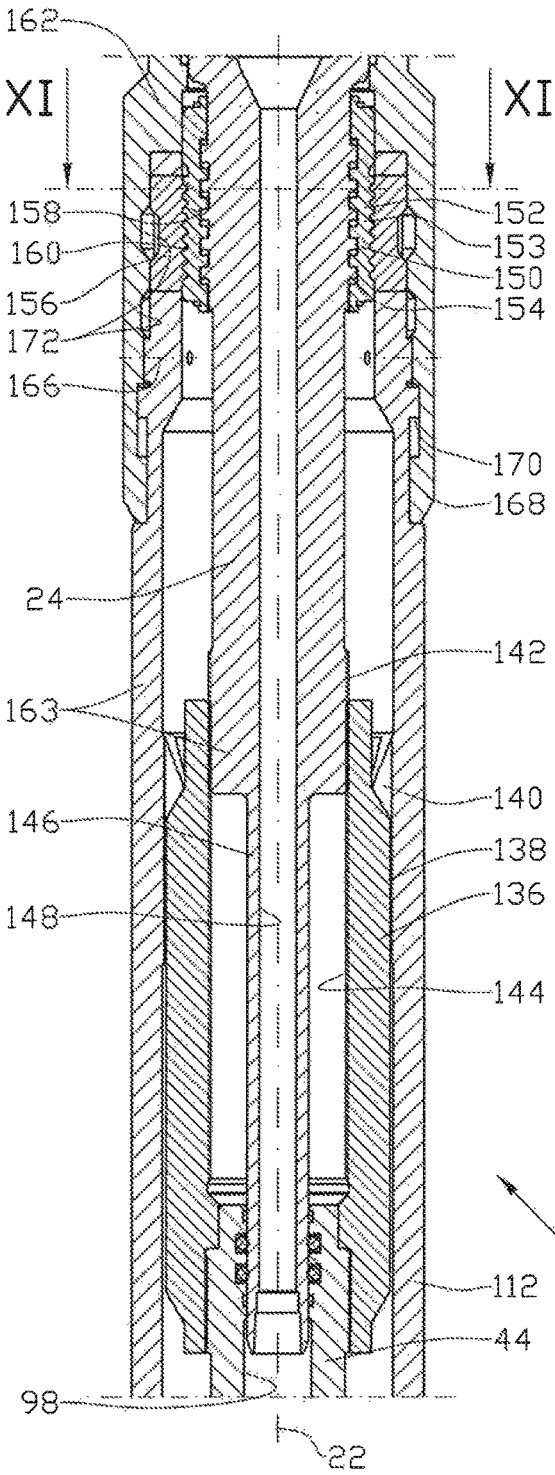
FIG. 11 shows a longitudinal section through the activation device of the apparatus and a releasing device in their initial position.
Figure 12:
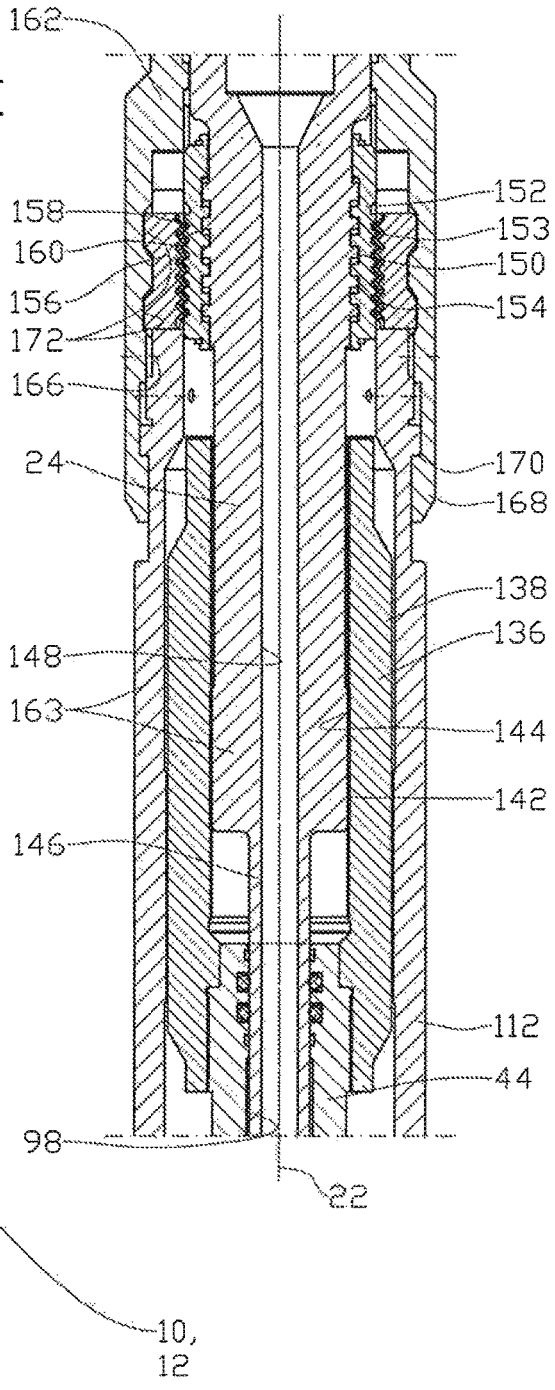
FIG. 12 shows the same as FIG. 11, but after the releasing device has been activated and the activation device has been tightened.
Figure 13:
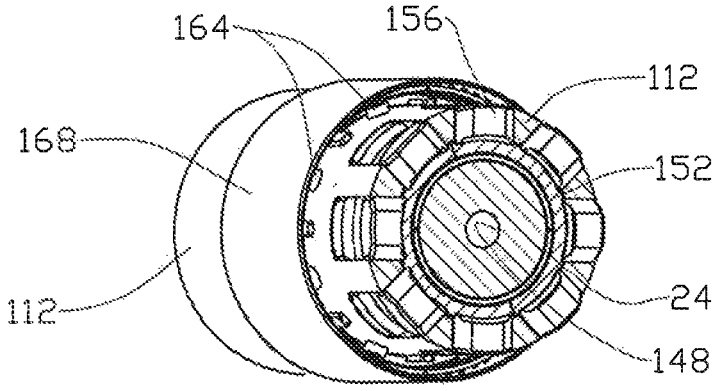
FIG. 13 shows a perspective section viewed along the section line XI-XI shown in FIG. 11.
Figure 14:
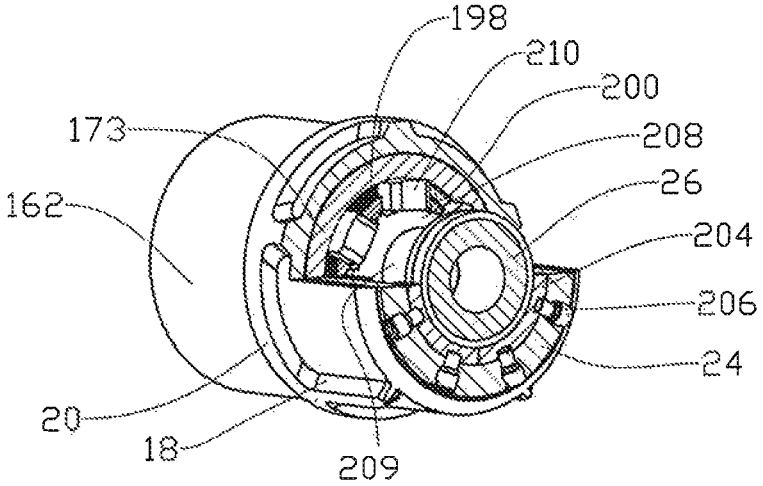
FIG. 14 shows a perspective section viewed along the section line XV-XV shown in FIG. 15.

The activation device 10 and releasing device 12 of the apparatus 1 are shown in FIGS. 11-13.

A splined nut 136 is displaceably arranged in the third housing portion 112 and is provided with external splines 138 complementarily fitting internal splines 140 of the third housing portion 112. The splined nut 136 is fixedly connected to the mandrel 44.

The activator 24, which projects into the third housing portion 112, is provided with an external thread 142 fitting an internal thread 144 of the splined nut 136. A cylindrical portion 146 of the activator 24 projects displaceably and sealingly into the through bore 98 of the mandrel 44. The activator 24 is also formed with a centric bore 148 extending through it.

The activator 24 is supported in a bearing bush 152 by means of a number of bearing flanges 150 projecting outwards. The bearing bush 152, which forms a suspension part 153, is internally provided with annular bearing surfaces 154 resting against the bearing flanges 150.

The bearing bush 152 is held in the axial position in the third housing portion 112 by means of a number of release blocks 156, here eight release blocks 156. Each release block 156 has a toothed surface 158 facing the bearing bush 152 and fitting against the teeth 160 of the bearing bush 152.

A fourth housing portion 162, which is attached to the holding-up element 18, encircles the releasing device 12. The housing 16 and the activator 24 constitute equipment components 163.

The eight release blocks 156 are arranged around the centre axis 22, as shown in FIG. 13 in which the fourth housing portion 162 is not shown.

When the apparatus 1 is to be activated, the activator 24 is rotated around the centre axis 22. The activator 24 is supported in the bearing bush 152 and thereby pulls the splined nut 136, which is prevented from rotating in the third housing portion 112, and the mandrel 44 in the axial direction towards the activator 24. If the activator 24 is rotated in the opposite direction, the splined nut 136 and the mandrel 44 are moved in the axial direction away from the activator.

During a displacement of the activator 24 relative to the mandrel 44, the cylindrical portion 146 is displaced axially in the bore 98.

The third housing portion 112 and the fourth housing portion 162 are held fixed to each other by means of shear bolts, called release bolts 164 below. Release bolts 164 are shown in FIG. 13, whereas their axial positions in the third housing portion 112 are indicated by bolt-centre lines 166 in FIGS. 11 and 12.

The third housing portion 112 and the fourth housing portion 162 are prevented from becoming fully separated by a ring nut 168 which is threadedly connected to the fourth housing portion 162, and which is arranged to come into abutment against a shoulder 170 encircling the third housing portion 112, see FIGS. 11 and 12.

If the third housing portion 112 and the fourth housing 162 are displaced in the axial direction away from each other, the release blocks 156 that normally rest against the inside of the fourth housing portion 162 may be displaced radially outwards into release grooves 172 in the fourth housing portion 162. The release blocks 156 then lose their engagement with the bearing bush 152, whereby the bearing bush 152 with the activator 24 and the splined nut 136 may be displaced axially in the third housing portion 112 without the activator 24 having to be rotated.

If it becomes necessary to disengage the apparatus 1 in some other way than by rotating the activator 24, a pulling tool not shown may be connected to the fishing neck 20, which is attached to the fourth housing portion 162, and then pull the fourth housing portion 162 until the release bolts 164 break. Said axial displacement between the third housing portion 112 and the fourth housing portion 162 may then take place.

Moreover, the housing 16 consists of the first, second, third and fourth housing portions 50, 92, 112, 162.

The valve 14, see FIGS. 14-18, is arranged inside the activator 24, which then forms a valve housing 173.

A valve slide 180 is externally provided with two outer seals 182 which are arranged to provide a seal between the valve slide 180 and the activator 24. An intermediate seal 184 is designed to control a flow rate through the valve 14.

Figure 15:
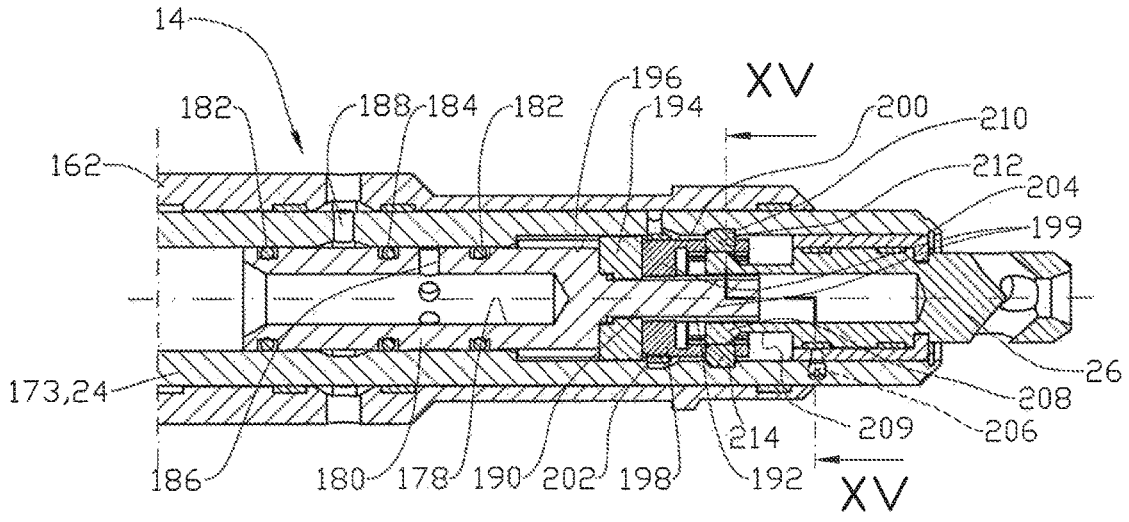
FIG. 15 shows a longitudinal section through the valve of the apparatus in a closed position.

Valve openings 186 in the valve slide 180 are closed relative to valve openings 188 in the activator 24 and in the fourth housing portion 162 when the valve 14 is in its closed position, as shown in FIG. 15.

The valve slide 180 is formed with a screw spindle 190 extending axially and extending centrically in the direction away from a valve bore 178. Moreover, the screw spindle 190 is provided with longitudinal grooves 192 fitting internally in an externally splined holding-up plate 194. The holding-up plate 194, which is arranged to prevent the screw spindle 190 from being rotatable relative to the activator 24, fits in an axially displaceable manner in internal complementary splines 196 of the activator 24.

A blocking nut 198 is screwed onto the screw spindle 190. The screw spindle 190 and the blocking nut 198 form a screw-and-nut connection 199. Externally, the blocking nut 198 is provided with a number of encircling blocking grooves 200. A blocking ring 202 is arranged to be in engagement with the blocking grooves 200 in order thereby to prevent or counteract an axial displacement of the blocking nut 198 in the direction away from the holding-up plate 194.

The valve activator 26 is supported in a bearing bush 204 in the activator 24. The valve activator 26 is kept in position axially via the bearing bush 204, which is connected to the activator 24 by means of a number of shear pins 206 in the form of shear screws 206, see FIG. 14.

In its radially external end portion, also called inward-projecting portion 208 in what follows, the valve activator 26 is in an axially displaceable rotary engagement with the blocking nut 198. A number of valve-stopping blocks 210 are arranged in corresponding radial openings 212 in the blocking nut 198. By means of the inward-projecting portion 208 of the valve activator 26, the valve-stopping blocks 210 are held in position in a block groove 214 in the activator 24.

By rotating the valve activator 26 relative to the activator 24, the valve can be opened and closed repeatedly. The valve-stopping blocks 210 stay in and are rotated in the block groove 124 as the valve slide 180 is simultaneously moved axially back and forth in the activator 24 depending on the direction of rotation of the valve activator 26 relative to the activator 24.

Figure 16:
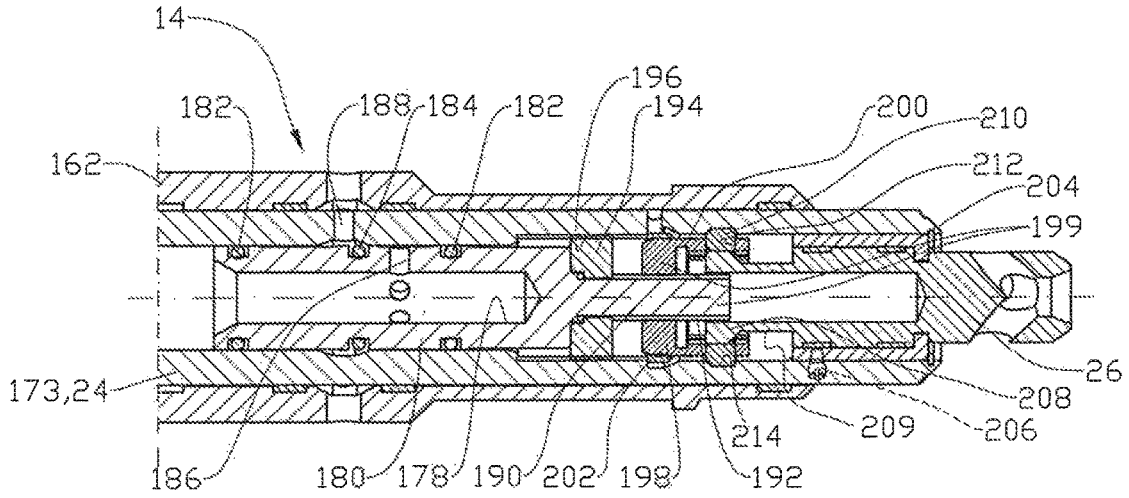
FIG. 16 shows the same as FIG. 15, but the valve is being opened.

In FIG. 16, the valve 14 is shown in an intermediate position in which the relative position of the intermediate seal 184 in the valve housing 180 determines the flowrate through the valve 14.

Figure 17:
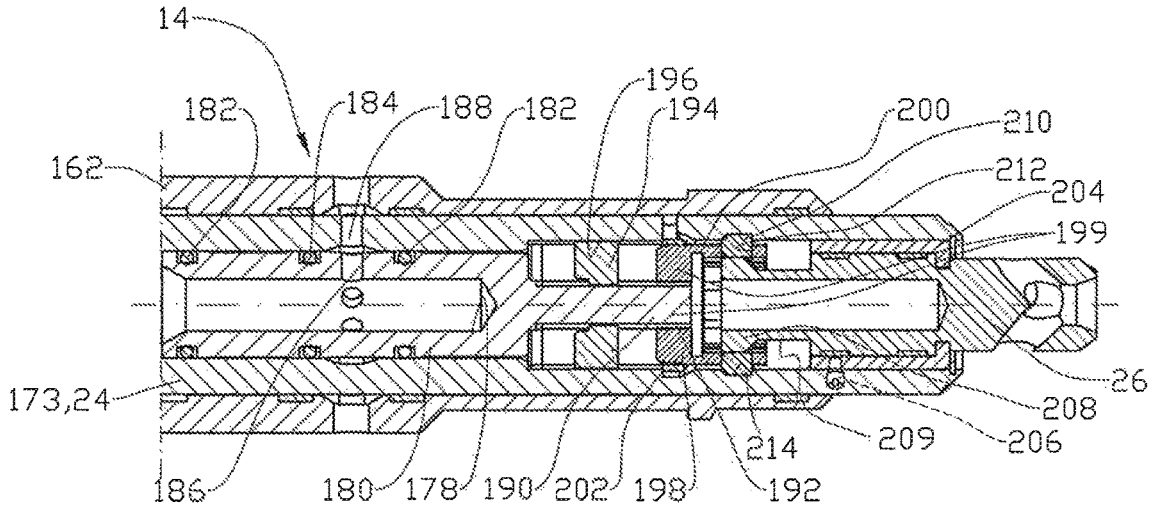
FIG. 17 shows the same as FIG. 15, but the valve is open.
Figure 18:
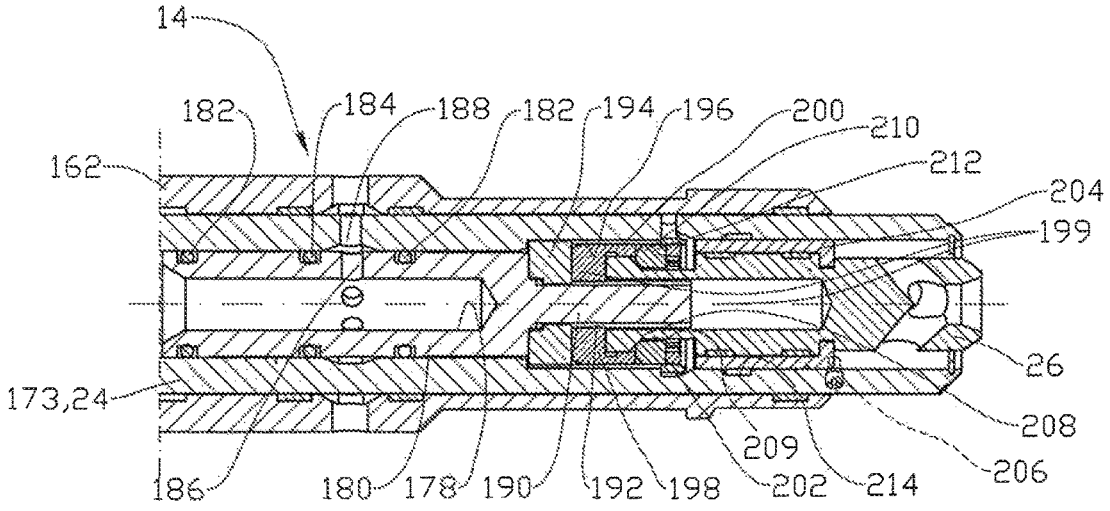
FIG. 18 shows the valve of FIG. 15, but the valve has been opened in an alternative manner.

In FIG. 17, the valve 14 is shown in the open position in which the opening 186 of the valve slide 180 is aligned with the opening 188 of the valve housing 173 so that fluid communication is provided between the valve bore 178 and the surroundings of the apparatus 1.

Should it be necessary to bring the valve 14 from the closed to the open position without rotating the valve activator 26, a compressive force may be applied to the valve activator 26 in the axial direction towards the valve 14, so that the shear pins or shear screws 206 break. The valve activator 26, with the associated inward-projecting portion 208, may thereby be moved somewhat into the blocking nut 198. The inward-projecting portion 208 thereby does not block the valve-stopping blocks 210 any longer. The valve-stopping blocks 210 are displaced axially out of the block groove 214 into a recess 209 in the external surface of the valve activator 26, after which the valve slide 180 can be displaced axially into its open position, see FIG. 18.

The engagement of the blocking ring 202 with the blocking nut 198 prevents the valve slide 180 from being axially displaceable towards its closed position, even if there is an overpressure inside the valve slide 180.

If the pressure is largest above the valve 14 relative to the orientation of the well, the pressure helps to push the valve slide 180 towards its open position. By above is meant, here, up towards the surface and towards the top of the apparatus or plug 1. If the pressure is largest below the valve 14, the pressure seeks to move the valve slide towards its closed position. The blocking ring 202 prevents the valve slide 180, even if it is in an intermediate position, from being displaceable towards its closed position. The blocking ring 202 also prevents adjacent components, such as the valve-stopping blocks 210, from falling out.

It should be noted that all the above-mentioned embodiments illustrate the invention, but do not limit it, and persons skilled in the art may construct many alternative embodiments without departing from the scope of the dependent claims. In the claims, reference numbers in brackets are not to be regarded as restrictive. The use of the verb "to comprise" and its different forms does not exclude the presence of elements or steps that are not mentioned in the claims. The indefinite article "a" or "an" before an element does not exclude the presence of several such elements.

The invention claimed is:

1. A sealing apparatus (1) for use in a well pipe (2), the sealing apparatus (1) comprises:

a mandrel (44) arranged around a centre axis (22) through the apparatus (1);

a radially movable gripping device (4) arranged around the mandrel (44);

a radially movable packer element (6) arranged around the mandrel (44); and an axially movable activation device (10) comprising an activator (24) rotatable around the centre axis (22), wherein the activator (24) is in threaded engagement with the mandrel (44) so that rotation of the activator (24) in a first direction provides axial movement of the mandrel (44) in a first direction, and also that a rotation of the activator (24) in a second direction opposite the first direction provides axial movement of the mandrel (44) in a second direction opposite the first direction; and a radially movable centralizer (8) arranged around the mandrel (44) for centring the apparatus (1);

wherein the activation device (10) is operatively connected to the gripping device (4), the packer element (6) and the centralizer (8) for their respective activation and radial movement between retracted, passive positions and expanded, active positions relative to the centre axis (22) when the activator (24) is rotated in the first direction, and also for deactivation and radial movement of the gripping device (4), the packer element (6) and the centralizer (8) between the expanded, active positions and retracted, passive positions relative to the centre axis (22) when the activator (24) is rotated in the second direction.

2. The apparatus according to claim 1, wherein the packer element (6) is arranged between the gripping device (4) and the centralizer (8).

3. The apparatus according to claim 1, wherein the gripping device (4) and the packer element (6) are blocked from activation before the centralizer (8) is at least partially activated.

4. The apparatus according to claim 1, further comprises a releasing device (12) operatively connected to the mandrel (44), the gripping device (4), the packer element (6) and the centralizer (8); and the releasing device (12) comprises a suspension part (153) for transmission of axial forces between equipment components (163) which includes the activator (24) and a housing portion (112), wherein the suspension part (153) is supported on the activator (24) and configured for cooperating with the activation device (10), the suspension part (153) being releasably connected to one of the equipment components.

5. The apparatus according to claim 1, wherein the apparatus (1) comprises a valve (14) arranged within the activator (24), the valve being in flow communication with an axial bore (98) extending through the mandrel (44) and arranged for selectively opening and closing to flow of a fluid through the valve (14), and thereby through the bore (98) of the mandrel (44).

6. A system comprising the apparatus (1) according to claim 1, and a well pipe (2), wherein the radially movable gripping device (4) is configured for fixing the apparatus (1) to an inside of the well pipe (2);

the radially movable packer element (6) is configured for sealing against the inside of the well pipe (2) and the mandrel (44);

the axially movable activation device (10) is designed to set up axial forces for activating the apparatus (1) in the well pipe (2) and for selective deactivation of the apparatus (1) from engagement with the well pipe (2);

wherein the radially movable centralizer (8) in its active position is configured for centring the apparatus (1) in the well pipe (2).

7. The apparatus (1) according to claim 1, wherein the apparatus is configured for activating the centralizer (8) before activating the gripping device (4) and the packer element (6).

8. A method for using the apparatus (1) according to claim 1 in a well pipe (2), the method comprises the following steps:

arranging the apparatus (1) with the at least one radially movable gripping device (4) and the packer element (6) in a retracted, passive position;

placing the apparatus (1) in a desired location in the well pipe (2); and activating the apparatus (1) by means of the activation device (10) to bring the apparatus (1) into an active position in which both the centralizer (8), the gripping device (4) and the packer element (6) are brought into expanded, active positions, the centralizer (8) in the active position being in contact with an inside of the well pipe (2), thereby centring the apparatus (1) in the well pipe (2).

9. The method according to claim 8, wherein the centralizer (8) is activated at least partially into the active position before the apparatus (1) is run into the well (2).

10. The method according to claim 8, wherein the method further includes a step of bringing the apparatus (1) from the active position into a passive position before the apparatus (1) is moved axially in the well (2) again.

11. The method according to claim 10, wherein the packer element (6) is brought into the passive position before the gripping device (4) and the centralizer (8) are each brought into passive positions.

12. The method according to claim 11, wherein the gripping device (4) is brought into the passive position before the centralizer (8) is brought into the passive position.

* * * * *